US008537080B2

(12) United States Patent
Yamashita et al.

(10) Patent No.: US 8,537,080 B2
(45) **Date of Patent: *Sep. 17, 2013**

(54) DISPLAY APPARATUS AND DRIVE METHOD THEREFOR, AND ELECTRONIC EQUIPMENT

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 13/317,738

(22) Filed: Oct. 27, 2011

(65) Prior Publication Data

US 2012/0062620 A1 Mar. 15, 2012

Related U.S. Application Data

(63) Continuation of application No. 12/071,283, filed on Feb. 19, 2008, now Pat. No. 8,089,429.

(30) Foreign Application Priority Data

Feb. 21, 2007 (JP) ..... 2007-041194

(51) Int. Cl.
*G09G 3/30* (2006.01)

(52) U.S. Cl.
USPC ..... 345/76; 345/45; 345/46; 345/77; 345/690; 315/169.1; 315/169.3

(58) Field of Classification Search
USPC ..... 345/76–92, 204, 690; 315/169.1–169.3
See application file for complete search history.

(56) References Cited

U.S. PATENT DOCUMENTS

| | | | | |
|---|---|---|---|---|
| 7,038,392 | B2 * | 5/2006 | Libsch et al. | 315/169.3 |
| 7,042,426 | B2 | 5/2006 | Shin | |
| 7,173,590 | B2 * | 2/2007 | Uchino et al. | 345/92 |
| 7,535,442 | B2 | 5/2009 | Yamashita et al. | |
| 8,089,429 | B2 * | 1/2012 | Yamashita et al. | 345/76 |
| 2005/0269959 | A1 * | 12/2005 | Uchino et al. | 315/169.3 |
| 2006/0125408 | A1 * | 6/2006 | Nathan et al. | 315/169.3 |
| 2007/0152920 | A1 | 7/2007 | Yamashita et al. | |
| 2009/0073092 | A1 | 3/2009 | Numao | |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| WO | WO-2007/018006 | A1 | 2/2007 |

* cited by examiner

*Primary Examiner* — Quan-Zhen Wang
*Assistant Examiner* — Jennifer Nguyen
(74) *Attorney, Agent, or Firm* — Rader, Fishman & Grauer PLLC

(57) ABSTRACT

A drive section sequentially supplies respective scanning lines with a control signal and supplies respective signal lines with a video signal to carry out a correction operation for holding a voltage equivalent to a threshold voltage of a drive transistor in a holding capacitance, and subsequently performs a write operation for writing the video signal in the holding capacitance, and before the correction operation, the drive section switches potentials at the bias line and adds a coupling voltage to one current terminal of the drive transistor via an auxiliary capacitance to carry out a preparation operation for an initialization to set a potential difference between a control terminal and the one current terminal of the drive transistor larger than the threshold voltage.

14 Claims, 16 Drawing Sheets

DISPLAY APPARATUS AND DRIVE METHOD THEREFOR, AND ELECTRONIC EQUIPMENT

CROSS REFERENCES TO RELATED APPLICATIONS

This is a Continuation Application of U.S. patent application Ser. No. 12/071,283 filed Feb. 19, 2008, which in turn claims priority from Japanese Application No.: 2007-041194 filed in the Japanese Patent Office on Feb. 21, 2007, the entire contents of which are incorporated herein by reference.

BACKGROUND OF THE INVENTION

1. Field of the Invention

The present invention relates to an active matrix display apparatus using a light emitting element for a pixel and a drive method for the display apparatus. Also, the invention relates to an electronic equipment provided with the display apparatus of this type.

2. Description of the Related Art

In recent years, development of flat panel light emitting display apparatuses using an organic EL device as a light emitting element has been activated. The organic EL device is a device utilizing such a phenomenon that light is emitted when an organic thin film is applied with an electric field. The organic EL device is driven at an applied voltage of 10 V or smaller and thus consumes a small amount of electric power. Also, the organic EL device is a light emitting element which emits light from itself. Therefore, the organic EL device does not need an illumination member and it is accordingly easy to realize a lighter weight and a thinner structure. Furthermore, a response speed of the organic EL device is several μs which is extremely high, and therefore an after image during video display is not generated.

Among the flat panel light emitting display apparatuses using the organic EL device for the pixel, development of an active matrix display apparatus in which thin film transistors are formed as drive elements in each pixel in an integrated manner has been particularly activated. Such an active matrix flat panel light emitting display apparatus is described in, for example, Japanese Unexamined Patent Application Publication Nos. 2003-255856, 2003-271095, 2004-133240, 2004-029791, and 2004-093682.

SUMMARY OF THE INVENTION

However, in the active matrix flat panel light emitting display apparatus described in the related art, a threshold voltage and a mobility in the transistors for driving light emitting elements (drive transistors) fluctuate due to process variations. In addition, current-voltage characteristics in the organic EL devices also vary over an elapse of time. Such characteristic fluctuation of the drive transistors and characteristic variation of the organic EL devices affect a light emission luminance. In order to control the light emission luminance uniform across a screen of the display apparatus, it is necessary to correct the above-mentioned characteristic variations of the drive transistors and the organic EL devices in the respective pixel circuits. Up to now, display apparatuses provided with a correction function for each pixel have been proposed. However, in such a display apparatus provided with the correction function in the related art, a correction operation is executed in each pixel. Thus, it is necessary to perform complicated operation on potentials at signal lines and power supply lines. Accordingly, there are problems in which a circuit configuration of the display apparatus is complicated and also component costs are also increased. In addition, in order to suppress distortions of potential waveforms appearing on the power supply lines and the signal lines, it is necessary to decrease wiring resistances and wiring capacities of the power supply lines and the signal lines. Accordingly, there is a problem in which a restriction is caused on a wiring layout.

In view of the above-mentioned related art problems, according to an embodiment of the present invention, it is desirable to provide a display apparatus in which a correction operation for each pixel can be executed without performing a complicated operation on potentials at power supply lines and signal lines.

According to the embodiment of the present invention, the following configuration is adopted. That is, the embodiment of the present invention provide a display device including: a pixel array section; and a drive section, the pixel array section including scanning lines arranged in rows, signal lines SL arranged in columns, pixels arranged in matrix at positions where the scanning lines respectively intersect with the signal lines, and bias lines arranged in parallel to the respective scanning lines, each of the pixels at least including a sampling transistor, a drive transistor, a light emitting element, a holding capacitance, and an auxiliary capacitance, a control terminal of the sampling transistor being connected to the scanning line, and current terminals in pair of the sampling transistor being connected between the signal line and a control terminal of the drive transistor, one of current terminals in pair of the drive transistor being connected to the light emitting element, and the other terminal being connected to the power supply line, the holding capacitance being connected between the control terminal and the one current terminal of the drive transistor, and the auxiliary capacitance being connected between the one of current terminals of the drive transistor and the bias line, in which the drive section sequentially supplies the respective scanning lines with a control signal and supplies the respective signal lines with a video signal to carry out a correction operation for holding a voltage equivalent to a threshold voltage of the drive transistor in the holding capacitance, and subsequently performs a write operation for writing the video signal in the holding capacitance, and before the correction operation, the drive section switches potentials at the bias line and adds a coupling voltage to the one current terminal of the drive transistor via the auxiliary capacitance to carry out a preparation operation for an initialization to set a potential difference between the control terminal and the one current terminal of the drive transistor larger than the threshold voltage.

It is desirable that when the preparation operation is carried out, the drive section holds the signal line at a reference potential and turns ON the sampling transistor to write the reference potential in the control terminal of the drive transistor. Also, the pixel performs a negative feedback of a current flowing between the current terminals in pair of the drive transistor to the holding capacitance during the write operation to carry out a correction in accordance with a mobility of the drive transistor on the video signal written in the holding capacitance. Furthermore, after the write operation, the pixel supplies the light emitting element with the drive current from the one current terminal of the drive transistor in accordance with the video signal written in the holding capacitance, and after the write operation, the drive section turns OFF the drive transistor and cuts off the control terminal of the drive transistor from the signal line to enable a bootstrap operation in which a potential at the control terminal of the drive transistor follows a potential variation at the one current terminal of the drive transistor.

According to the embodiment of the present invention, in order to execute the necessary correction operation for the respective pixels, the auxiliary capacitance is added. This auxiliary capacitance is connected between the current terminal functioning as an output of the drive transistor and the predetermined bias line. By scanning the voltage of the bias line and inputting the coupling voltage to the current terminal of the drive transistor via the, the necessary correction operation for the pixels is enabled. As a result, it is not necessary to perform complicated potential operations in the power supply line and the signal line, and the circuit configuration of the drive section is simplified, which leads to the decrease in costs. In addition, it is not necessary to decrease wiring resistances and wiring capacities of the signal lines and the power supply lines in particular, and the number of restriction conditions on the wiring layout is decreased. Thus, it is possible to obtain the higher quality of the panel without increasing the costs. Moreover, a cost for a driver IC built in the drive section is reduced and a lower power consumption in the panel can be realized.

DESCRIPTION OF THE PREFERRED EMBODIMENTS

Figure 1:
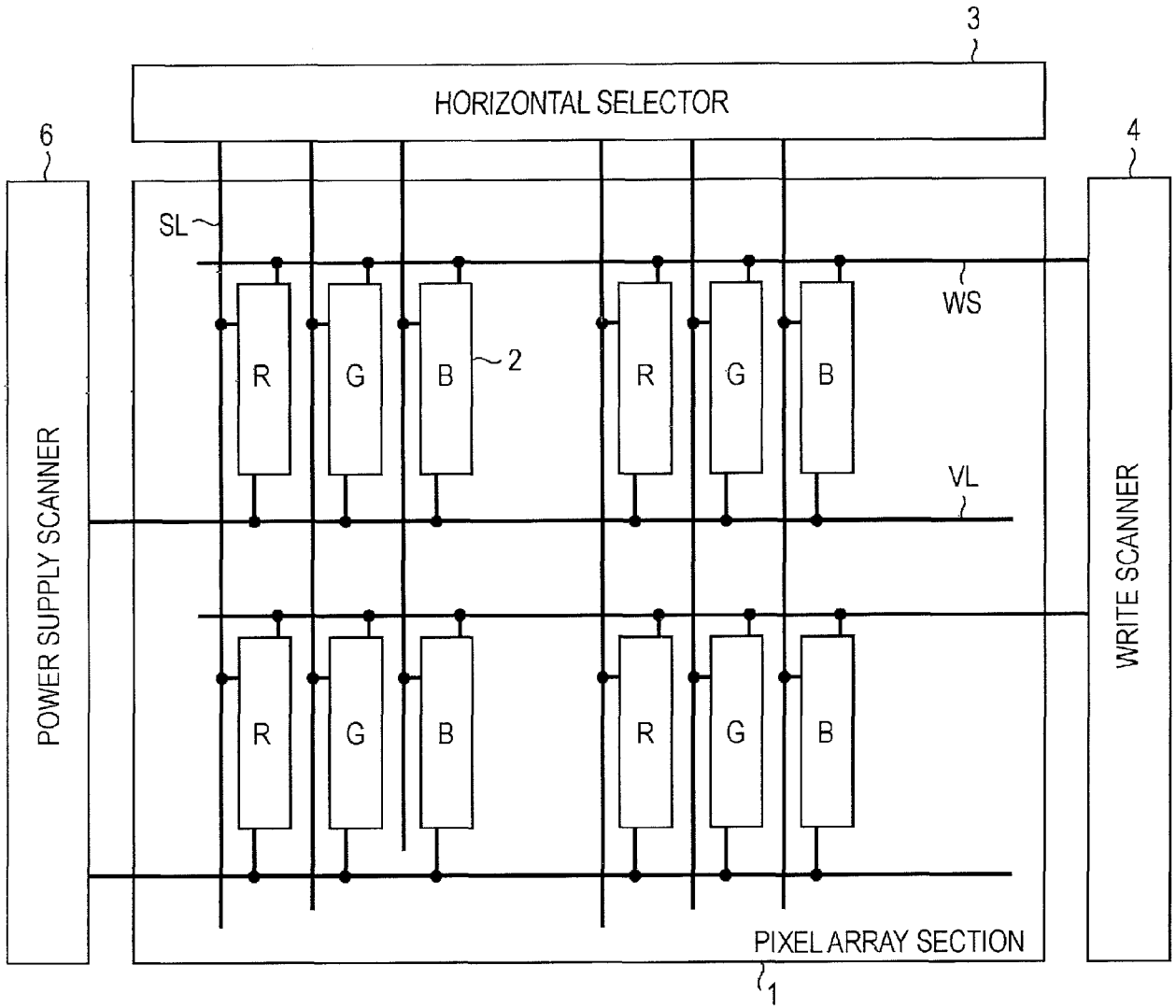
FIG. 1 is a block diagram of an entire configuration of a display apparatus according to a related development.

Hereinafter, embodiments of the present invention will be described in detail with reference to the drawings. First, in order to clarify the background of the present invention, a display apparatus according to a development related to the present invention will be described as a part of the present invention. FIG. 1 is a block diagram of an entire configuration of a display apparatus according to a related development. As described in the drawing, the present display apparatus is composed of a pixel array section 1 and a drive section adapted to drive the pixel array section 1. The pixel array section 1 is provided with scanning lines WS arranged in rows, signal lines SL arranged in columns, pixels 2 arranged in matrix at positions where the scanning lines intersect with the signal lines, and power feed lines (power supply lines) VL arranged corresponding to the row of the respective pixels 2. It should be noted that according to the present example, one of three primary colors R, G, and B is assigned to the respective pixels 2, and it is possible to perform color display. However, the configuration is not limited to the above, and a device adapted to perform monochrome display is also included. The drive section is provided with a write scanner 4 adapted to sequentially supply a control signal to the respective scanning lines WS to perform a line sequential scanning on the pixels 2 in units of row, a power supply scanner 6 adapted to supply a power supply voltage switching between a first potential and a second potential to the respective power feed lines VL in accordance with this line sequent scanning, and a signal selector (horizontal selector) 3 adapted to supply a signal potential functioning as a video signal and a reference potential to the signal lines SL arranged in columns in accordance with this line sequent scanning.

Figure 2:
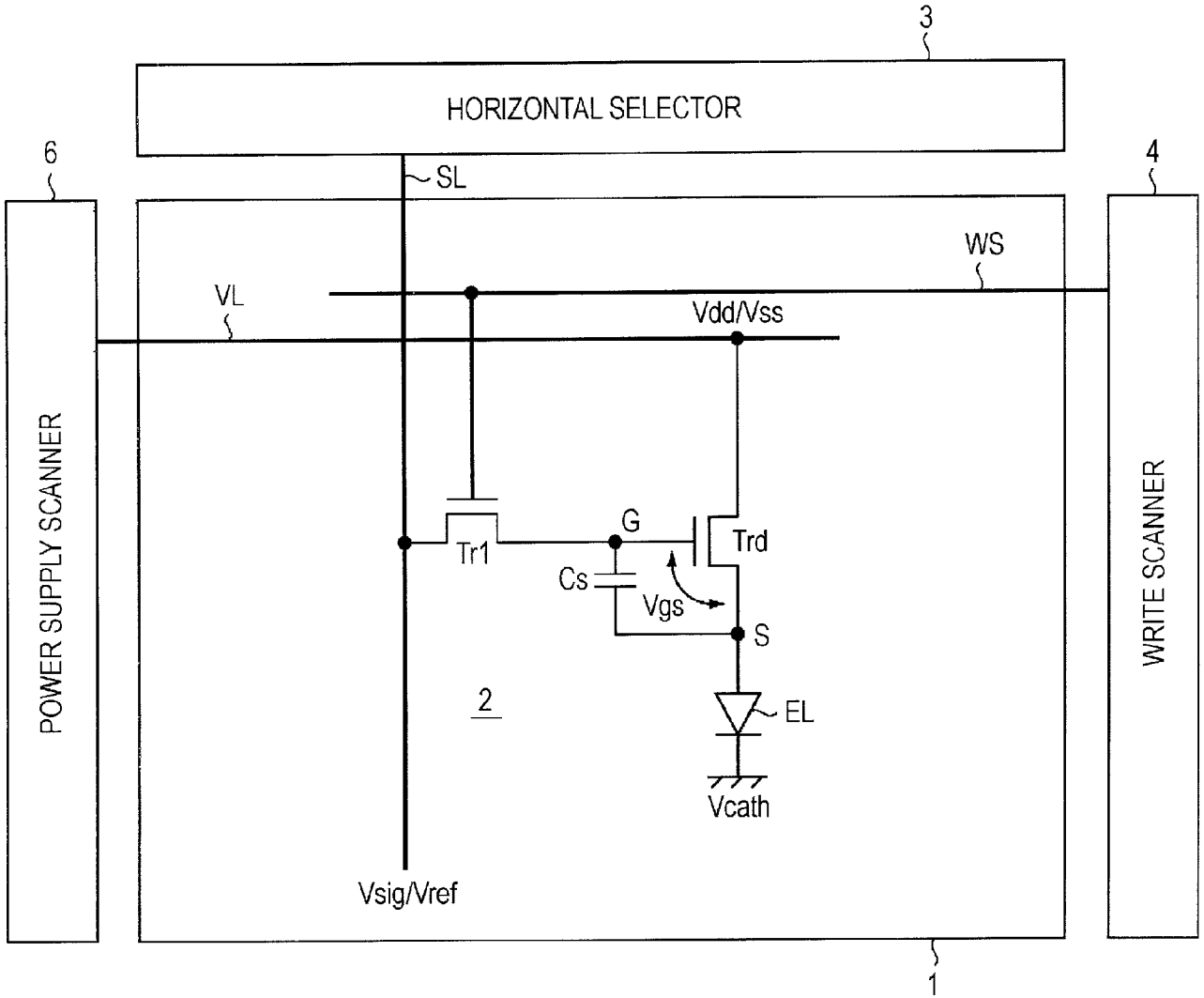
FIG. 2 is a circuit diagram of a specific configuration of the display apparatus illustrated in FIG. 1.

FIG. 2 is a circuit diagram of a specific configuration and a connecting relation of the pixel 2 included in the display apparatus illustrated in FIG. 1. As described in the drawing, this pixel 2 includes a light emitting element EL represented by an organic EL device, a sampling transistor Tr1, a drive transistor Trd, and a holding capacitance Cs. In the sampling transistor Tr1, a control terminal (gate) is connected to the corresponding scanning line, one of current terminals in pair (source and drain) is connected to the corresponding signal line SL, and the other of the current terminals is connected to a control terminal (gate G) of the drive transistor Trd. In the drive transistor Trd, one of current terminals in pair (source S and drain) is connected to the light emitting element EL, and the other of the current terminals is connected to the corresponding power feed line VL. In the present example, the drive transistor Trd is of an N channel type, and the drain is connected to the power feed line VL. On the other hand, the source S is connected to an anode of the light emitting element EL as an output node. A cathodes of the light emitting element EL is connected to a predetermined cathode potential Vcath. The holding capacitance Cs connects the source S and the gate G of the drive transistor Trd.

In such a configuration, the sampling transistor Tr1 achieves a continuity in accordance with a control signal supplied from the scanning line WS, and samples a signal potential supplied from the signal line SL to be held in the holding capacitance Cs. The drive transistor Trd receives a current supply from the power feed line VL at a first potential (high potential Vdd) and flows a drive current to the light emitting element EL in accordance with the signal potential held in the holding capacitance Cs. In order to achieve a continuity state in the sampling transistor Tr1 during a period of time when the signal line SL is at the signal potential, the write scanner 4 outputs a control signal at a predetermined pulse width to a control line WS, thus holding the signal potential in the holding capacitance Cs and performing a correction with respect to a mobility μ of the drive transistor Trd on the signal potential at the same time. After that, the drive transistor Trd supplies a drive current in accordance with a signal potential Vsig written in the holding capacitance Cs to the light emitting element EL and starts a light emitting operation.

The pixel circuit 2 is also provided with a threshold voltage correction function in addition to the above-mentioned mobility correction function. That is, before the sampling transistor Tr1 samples the signal potential Vsig, the power supply scanner 6 switches the power feed line VL at a first timing from the first potential (high potential Vdd) to a second potential (low potential Vss). In addition, also before the sampling transistor Tr1 samples the signal potential Vsig, the write scanner 4 achieves the continuity in the sampling transistor Tr1 at a second timing to apply the gate G of the drive transistor Trd with a reference potential Vref from the signal line SL and the source S of the drive transistor Trd and to set the second potential (Vss) at the same time. At a third timing after the second timing, the power supply scanner 6 switch the power feed line VL from the second potential Vss to the first potential Vdd to hold a voltage equivalent to a threshold voltage Vth of the drive transistor Trd in the holding capacitance Cs. With the above-mentioned threshold voltage correction function, the present display apparatus can cancel the influence of the threshold voltages Vth of the drive transistor Trd fluctuating in each pixel.

The pixel circuit 2 is further provided with a bootstrap function. That is, the write scanner 4 releases the application of the control signal with respect to the scanning line WS in a stage in which the signal potential Vsig is held in the holding capacitance Cs to achieve a non-continuity state in the sampling transistor Tr1. The gate G of the drive transistor Trd is electrically cut off from the signal line SL. Thus, the potential at the gate G is associated with a potential variation at the source S of the drive transistor Trd, and it is possible to maintain the voltage Vgs between the gate G and the source S constant.

Figure 3:
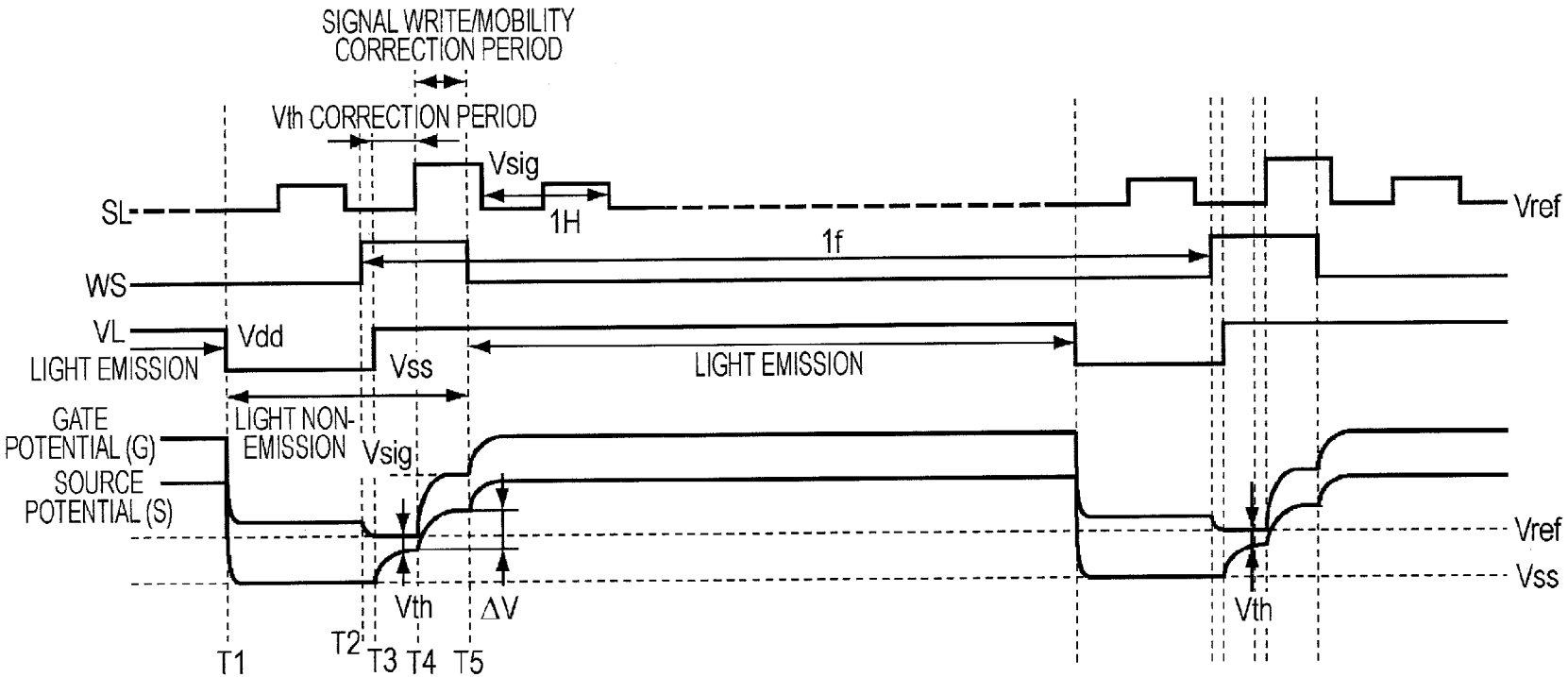
FIG. 3 is a timing chart used for describing an operation of the display apparatus illustrated in FIG. 2.

FIG. 3 is a timing chart used for describing an operation of the pixel circuit 2 illustrated in FIG. 2. FIG. 3 illustrates a potential change of the scanning line WS, a potential change of the power feed line VL, and a potential change of the signal line SL while a time axis is commonly used. In addition, FIG. 3 illustrates potential changes of the gate G and the source S of the drive transistor in parallel with these potential changes.

As described above, the scanning line WS is applied with a control signal pulse for turning ON the sampling transistor Tr1. The scanning line WS is applied with this control signal pulse in accordance with the line sequential scanning in the pixel array section in a 1 field (1f) cycle. Similarly, at the power supply line VL, the high potential Vdd and the low potential Vss are switched in the 1 field (1f) cycle. The signal line SL is supplied with a video signal while the signal potential Vsig and the reference potential Vref are switched in a 1 horizontal period (1H).

As illustrated in the timing chart of FIG. 3, the pixel enters a light non-emission period in the current field from a light emission period in the previous field, and thereafter enters the light emission period in the current field. During this light non-emission period, a preparation operation, a threshold voltage correction operation, a signal write operation, a mobility correction operation, and the like are performed.

During the light emission period in the previous field, the power feed line VL is at the high potential Vdd, and the drive transistor Trd supplies the light emitting element EL with a drive current Ids. The drive current Ids passes through the light emitting element EL from the power feed line VL at the high potential Vdd via the drive transistor Trd and flows into a cathode line.

Subsequently, when the light non-emission period in the current field begins, at a timing T1, the power feed line VL is switched from the high potential Vdd to the low potential Vss. As a result, the power feed line VL discharges to Vss, and furthermore a potential at the source S of the drive transistor Trd is lowered to Vss. As a result, an anode potential at the light emitting element EL (that is, a source potential at the drive transistor Trd) is in a reverse bias state. The drive current does not flow and the light emission is turned OFF. In addition, in associated with the potential fall of the source S of the drive transistor, the potential at the gate G is also lowered.

Then, at a timing T2, by switching the scanning line WS from a low level to a high level, the continuity in the sampling transistor Tr1 is achieved. At this time, the signal line SL is at the reference potential Vref. Therefore, the potential at the gate G of the drive transistor Trd is turned into the reference potential Vref at the signal line SL through the sampling transistor Tr1 in the continuity state. At this time, the potential at the source S of the drive transistor Trd is at Vss, which is a potential sufficiently lower than Vref. In this manner, the initialization is performed so that a voltage Vgs between the gate G and the source S of the drive transistor Trd is larger than the threshold voltage Vth of the drive transistor Trd. A period T1-T3 from the timing T1 to a timing T3 is a preparation period for setting the voltage Vgs between the gate G and the source C of the drive transistor Trd equal to or larger than Vth in advance.

After that, at the timing T3, the power feed line VL is transit from the low potential Vss to the high potential Vdd, and the potential at the source S of the drive transistor Trd starts to increase. When the voltage Vgs between the gate G and the source C of the drive transistor Trd reaches the threshold voltage Vth, the current is cut off. In this manner, a voltage equivalent to the threshold voltage Vth of the drive transistor Trd is written in the holding capacitance Cs. This is the threshold voltage correction operation. At this time, in order to achieve such a situation that the current exclusively flows into a side of the holding capacitance Cs and the current does not flow into the light emitting element EL, the cathode potential Vcath is set so that the light emitting element EL is cut off. This threshold voltage correction operation is completed until when the potential at the signal line SL is switched from Vref to Vsig at a timing T4. A period T3-T4 from the timing T3 to the timing T4 is the mobility correction period.

At the timing T4, the signal line SL is switched from the reference potential Vref to the signal potential Vsig. At this time, the sampling transistor Tr1 remains in the continuity state. Therefore, the potential at the gate G of the drive transistor Trd is turned into the signal potential Vsig. At this time, as the light emitting element EL is in the cut off state (high impedance state), the current flowing between the drain and the source of the drive transistor Trd exclusively flows into the holding capacitance Cs and an equivalent capacitance of the light emitting element EL, and charging starts. After that, before a timing T5 when the sampling transistor Tr1 is turned OFF, the potential at the source S of the drive transistor Trd is increased by ΔV. In this manner, the signal potential Vsig of the video signal is written in the holding capacitance Cs while being added to Vth, and also a voltage ΔV for the mobility correction is subtracted from the voltage held in the holding capacitance Cs. Therefore, a period T4-T5 from the timing T4 to the timing T5 is the signal write period/the mobility correction period. In this manner, during the signal write period T4-T5, the write of the signal potential Vsig and the adjustment for the correction amount ΔV are performed at the same time. As Vsig is higher, a current Ids supplied from the drive transistor Trd is larger, and the absolute value of ΔV is also larger. Therefore, the mobility correction in accordance with the light emission luminance level is carried out. In a case where Vsig is set constant, as the mobility μ of the drive transistor Trd is larger, the absolute value of ΔV is larger. In other words, as the mobility μ is larger, a negative feedback amount ΔV to the holding capacitance Cs is larger, and thus the fluctuation in the mobility μ for each pixel can be eliminated.

Finally, at the timing T5, as described above, the scanning line WS is transit to the low level side, and the sampling transistor Tr1 is in the OFF state. As a result, the gate G of the drive transistor Trd is cut off from the signal line SL. At the same time, the drain current Ids starts flowing into the light emitting element EL. As a result, the anode potential at the light emitting element EL is increased in accordance with the drive current Ids. The increase in the anode potential at the light emitting element EL is namely the increase in the potential at the source S of the drive transistor Trd. When the potential at the source S of the drive transistor Trd is increased, the potential at the gate G of the drive transistor Trd is also increased in associated therewith due to the bootstrap operation of the holding capacitance Cs. The increased amount of the gate potential is equal to the increased amount of the source potential. Accordingly, the voltage Vgs between the gate G and the source S of the drive transistor Trd is held constant during the light emission period. This value of Vgs is obtained based on the signal potential Vsig with corrections applied on the threshold voltage Vth and the mobility μ.

As apparent from the above description, in the display apparatus according to the related development, before the threshold voltage correction operation, the preparation operation therefor is performed. Thus, the power feed line VL (power supply line) is switched between the high potential and the low potential. The power feed line VL is laid out in parallel with the scanning line WS and aligned in a lateral direction of the pixel array section (panel) in a line. In general cases, similarly to the scanning line WS (gate line), high resistance wiring made of metal molybdenum (Mo) or the like is used for the wiring layout lateral direction. The high resistance power feed line VL is driven by the power supply scanner 6, but it is necessary to supply the power feed line VL with a large current at the light of light emission. Therefore, a voltage drop is generated along the power feed line VL at the center and the end sections of the panel. For this reason, shading or cross talk is generated to degrade uniformity of the screen. It is also conceivable to use a low resistance material to produce the power feed line VL separately from the scanning line WS. However, if different wiring materials are used for the scanning line WS and the power feed line VL in this way, the number of steps to produce the panel is increased, which leads to the increase in manufacturing costs.

Figure 4:
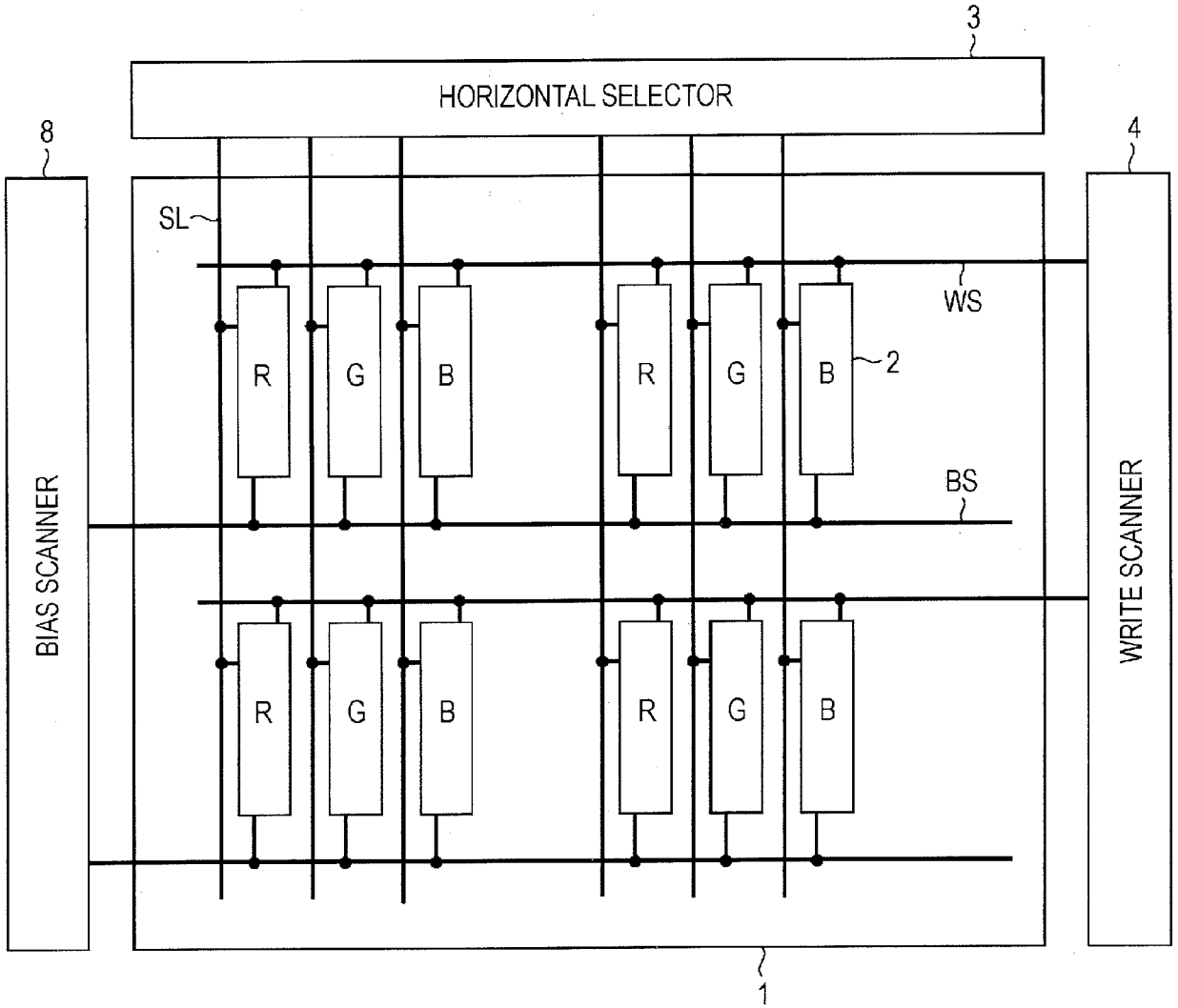
FIG. 4 is a block diagram of a display apparatus according to an embodiment of the present invention.

FIG. 4 is a block diagram of an entire display apparatus according to an embodiment of the present invention. The present display apparatus is made to deal with the drawbacks of the display apparatus according to the above-mentioned related development. To facilitate the understanding, the display apparatus according to the embodiment of the present invention illustrated in FIG. 4 uses reference numerals corresponding to those for the display apparatus according to the related development illustrated in FIG. 1. A difference resides in that a bias line BS is arranged instead of the power feed line VL. The bias line BS is laid out in parallel with the scanning line WS. Unlike the power feed line VL, it is not necessary to supply the bias line BS with the large current. Thus, the same wiring material as that for the scanning line WS can be used, and it is basically possible to fabricate the scanning lines WS and the bias lines BS in the same step. In addition, a bias scanner 8 is arranged for scanning the bias line BS. The power supply scanner 6 used in the related development example needs to use a high efficiency scanner having a high current drive performance for switching the power supply voltage. In contrast to this, the bias scanner 8 merely switches the bias voltage on the bias line BS and can basically use the same general use scanner as the write scanner 4. It should be noted that although not illustrated in FIG. 4, instead of removing the power feed line VL, a power supply line for supplying the respective pixels 2 with a power supply voltage Vdd is arranged.

Figure 5:
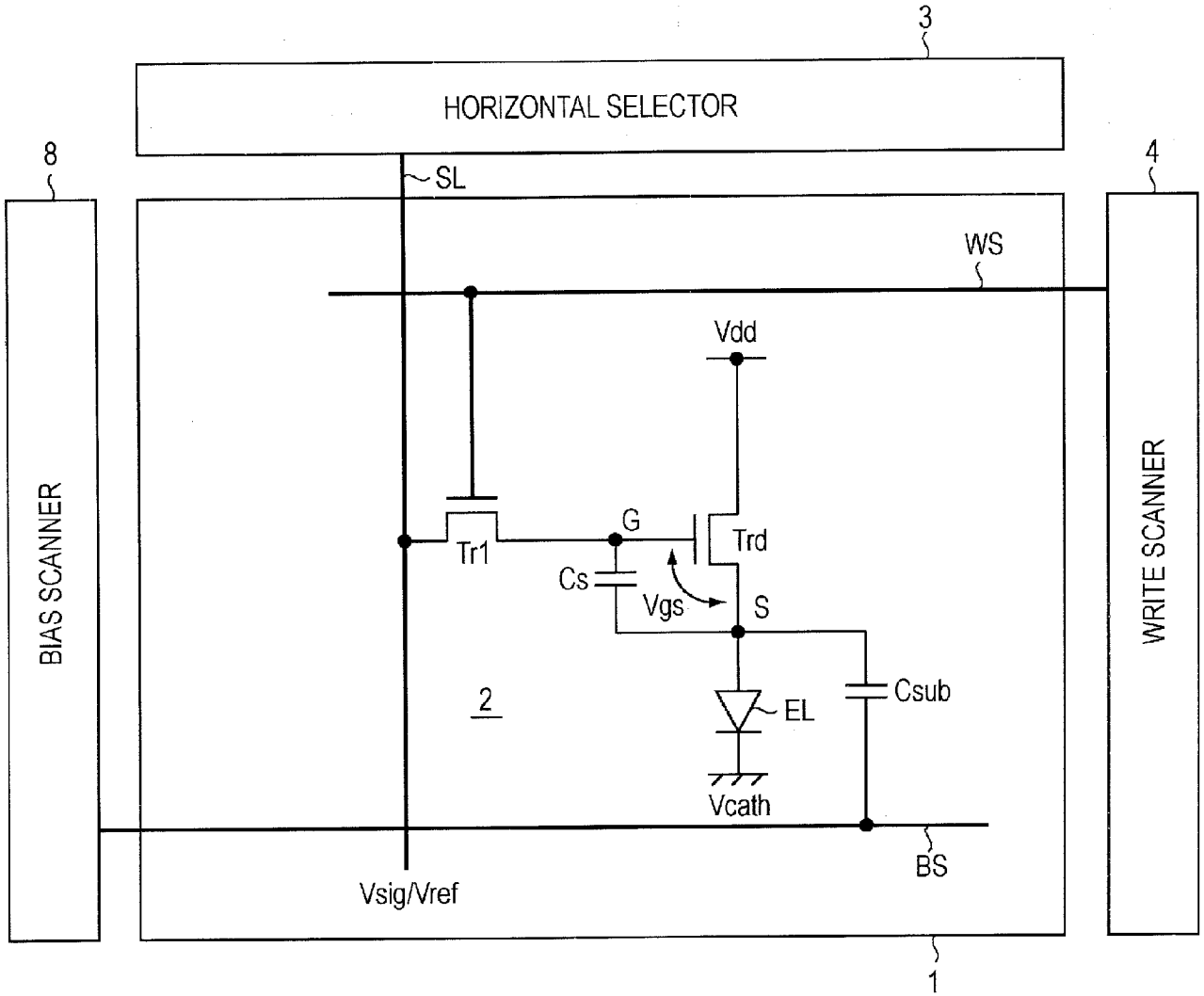
FIG. 5 is a circuit diagram of a specific configuration of the display apparatus illustrated in FIG. 4.

FIG. 5 is a circuit diagram of the display apparatus illustrated in FIG. 4 according to the embodiment of the present invention. To facilitate the understanding, parts corresponding to those for the display apparatus illustrated in FIG. 2 according to the related development are allocated with the same reference numerals. The present display apparatus is basically composed of the pixel array section 1 and the drive section. The pixel array section 1 is provided with the scanning lines WS arranged in rows, the signal lines SL arranged in columns, and the pixels arranged in matrix at positions where the scanning lines WS respectively intersect with the signal lines SL. In the drawing, to facilitate the understanding, one of the pixels 2 is represented. In addition, the pixel array section 1 is provided with the bias lines BS arranged in parallel to the respective scanning lines WS.

The pixel 2 is at least includes the sampling transistor Tr1, the drive transistor Trd, the light emitting element EL, the holding capacitance Cs, and an auxiliary capacitance Csub. In the sampling transistor Tr1, the control terminal is connected to the scanning line WS, and the current terminals in pair are connected between the signal line SL and the control terminal of the drive transistor Trd (gate G). In the drive transistor Trd, one of the current terminals in pair (source S) is connected to the light emitting element EL, and the other terminal (drain) is connected to the power supply line Vdd. The holding capacitance Cs connects the gate G and the source S of the drive transistor Trd. The auxiliary capacitance Csub is connected between the source S of the drive transistor Trd and the bias line BS.

The drive section is provided with the horizontal selector 3 connected to the signal line SL, the write scanner 4 connected to the scanning line WS, and the bias scanner 8 connected to the bias line BS. The write scanner 4 is adapted to supply the control signal to the scanning line WS, and the horizontal selector 3 is adapted to supply the video signal to the signal line SL, thus performing a correction operation for holding a voltage equivalent to the threshold voltage Vth of the drive transistor Trd in the holding capacitance Cs. Subsequently, a write operation for writing the signal potential Vsig of the video signal in the holding capacitance Cs is performed. Before the correction operation, the bias scanner 8 switches the potential at the bias line BS to add a coupling voltage to the source S of the drive transistor Trd via the auxiliary capacitance Csub, thus performing a preparation operation for an initialization to set a potential difference Vgs between the gate G and the source S of the drive transistor Trd larger than the threshold voltage Vth. It should be noted that when this preparation operation is performed, the signal line SL is held in the reference potential Vref and the sampling transistor Tr1 is turned ON to write the reference potential Vref in the gate G of the drive transistor Trd.

In the write operation of the signal potential Vsig, the pixel 2 performs a negative feedback of the current flowing between the drain and the source of the drive transistor Trd to the holding capacitance Cs, thus carrying out a correction in accordance with the mobility μ of the drive transistor Trd on the signal potential Vsig of the video signal written in the holding capacitance Cs.

Also, after the write operation of the signal potential Vsig of the video signal, the pixel 2 supplies a drive current in accordance with the signal potential Vsig held in the holding capacitance Cs from the source S of the drive transistor Trd to the light emitting element EL. At this time, after the write operation of the signal potential Vsig, the write scanner 4 turns OFF the sampling transistor Tr1 to cut off the gate G of the drive transistor Trd from the signal line SL, thus enabling a bootstrap operation in which the potential at the gate G of the drive transistor Trd follows the potential variation at the source S of the drive transistor Trd.

Figure 6:
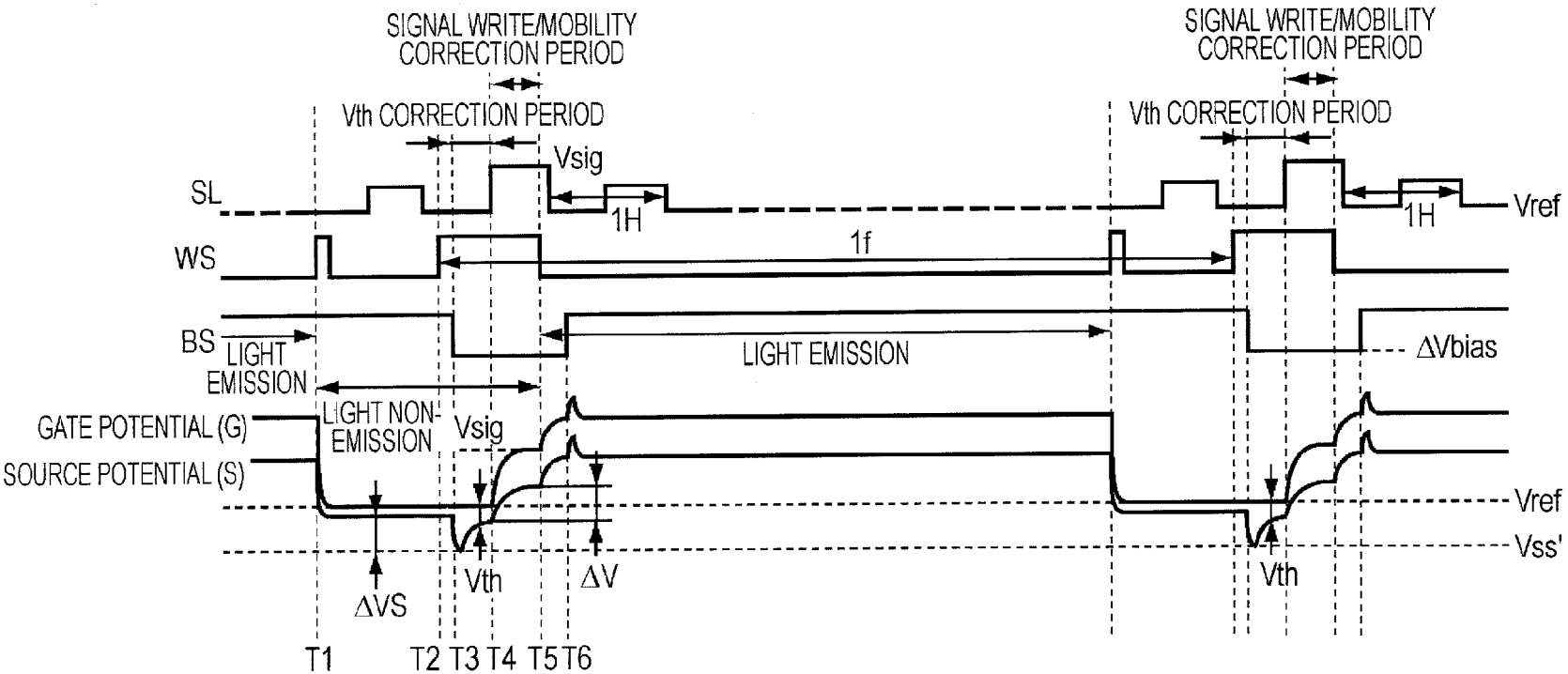
FIG. 6 is a timing chart used for describing an operation of the display apparatus illustrated in FIG. 5.

FIG. 6 is a timing chart used for describing an operation of the display apparatus illustrated in FIG. 5. To facilitate the understanding, parts corresponding to those for the timing chart illustrated in FIG. 3 are allocated with the corresponding reference numerals. The timing chart of FIG. 6 illustrates a potential change of the bias line BS instead of the potential change of the power feed line VL. As described in the drawing, the potential at this bias line BS varies by just ΔVbias between the high potential and the low potential. It should be noted that the power supply voltage is typically fixed to Vdd.

At a timing T1, when the current field begins, the scanning line WS is applied with a short control pulse, and the sampling transistor Tr1 is temporarily turned ON. At this time, as the signal line SL is at the reference potential Vref, the reference voltage Vref is written in the gate G of the drive transistor Trd. As this Vref is set as a sufficiently low voltage, Vgs of the drive transistor Trd is equal to or lower than Vth and the cut-off is caused. Therefore, the drive current does not flow into the light emitting element EL and the light non-emission state is achieved. In this manner, the display apparatus according to the embodiment of the present invention enters the light non-emission period by adding the short control pulse to the scanning line WS.

Next, at a timing T2, the scanning line WS is again applied with a control signal pulse having a large width to turn ON the sampling transistor Tr1. At this time, the potential at the signal line SL is also Vref.

At a timing T3 immediately after the timing T2, the bias line BS is switched from the high potential to the low potential. As a result, a minus coupling voltage is input to the source S of the drive transistor Trd via the auxiliary capacitance Csub, and the potential at the source S is lowered by ΔVs. At this time, when a potential change amount of the bias line BS is set as ΔVbias, ΔVs is represented in the following expression due to a capacity coupling.

$$\Delta Vs = \Delta V\text{bias} \times C\text{sub}/(Cs + C\text{sub})$$

In this manner, in a state where the gate G of the drive transistor Trd is grounded to the reference potential Vref, it is possible to input the minus coupling ΔVs to the source S. Such a potential difference ΔVbias of the bias line BS is set that Vgs>Vth is established through this coupling. With this configuration, the drive transistor Trd can be set in the ON state, and the threshold voltage correction operation thereafter can be performed.

At this time, with the input of the minus coupling ΔVs, the drive transistor Trd is set in the ON state but the power supply line at this time is fixed to Vdd. Thus, a current flows into the drive transistor Trd. At this time, the light emitting element EL is in the reverse bias state, and the current does not flow. This, the potential at the source S is increased. When Vgs=Vth is just established, the drive transistor Trd is cut off, and the threshold voltage correction operation is completed.

At a timing T4, the signal line SL is switched from the reference potential Vref to the signal potential Vsig. At this time, the sampling transistor Tr1 remains in the continuity state. Therefore, the potential at the gate G of the drive transistor Trd is turned into the signal potential Vsig. At this time, as the light emitting element EL is in the cut off state (high impedance state) at the beginning, the current flowing between the drain and the source of the drive transistor Trd exclusively flows into the holding capacitance Cs and the equivalent capacitance of the light emitting element EL, and charging starts. After that, before a timing T5 when the sampling transistor Tr1 is turned OFF, the potential at the source S of the drive transistor Trd is increased by ΔV. In this manner, the signal potential Vsig of the video signal is written in the holding capacitance Cs while being added to Vth, and also a voltage ΔV for the mobility correction is subtracted from the voltage held in the holding capacitance Cs. Therefore, a period T4-T5 from the timing T4 to the timing T5 is the signal write period/the mobility correction period. In this manner, during the signal write period T4-T5, the write of the signal potential Vsig and the adjustment for the correction amount ΔV are performed at the same time. As Vsig is higher, the current Ids supplied from the drive transistor Trd is larger, and the absolute value of ΔV is also larger. Therefore, the mobility correction in accordance with the light emission luminance level is carried out. In a case where Vsig is set constant, as the mobility μ of the drive transistor Trd is larger, the absolute value of ΔV is larger. In other words, as the mobility μ is larger, the negative feedback amount ΔV to the holding capacitance Cs is larger, and it is thus possible to eliminate the fluctuation the mobility μ for the respective pixels.

At the timing T5, the scanning line WS is transit to the low level side, and the sampling transistor Tr1 is in the OFF state. As a result, the gate G of the drive transistor Trd is cut off from the signal line SL. At the same time, the drain current Ids starts flowing into the light emitting element EL. As a result, the anode potential at the light emitting element EL is increased in accordance with the drive current Ids. The increase in the anode potential at the light emitting element EL is namely the increase in the potential at the source S of the drive transistor Trd. When the potential at the source S of the drive transistor Trd is increased, the potential at the gate G of the drive transistor Trd is also increased in associated therewith due to the bootstrap operation of the holding capacitance Cs. The increased amount of the gate potential is equal to the increased amount of the source potential. Accordingly, the voltage Vgs between the gate G and the source S of the drive transistor Trd is held constant during the light emission period. This value of Vgs is obtained based on the signal potential Vsig with corrections applied on the threshold voltage Vth and the mobility μ.

After the sampling transistor Tr1 is turned OFF and the light emitting element EL starts emitting light, at a timing T6, the potential of the bias line BS is returned from the low potential to the high potential to prepare for the operation for the next field. At the timing T6, when the bias line BS is returned from the low level to the high level, a plus coupling is input to the source S of the drive transistor Trd. At this time, the gate G of the drive transistor Trd is in the high impedance state. As the potential written in the holding capacitance Cs is held as it is, the potential which is temporarily changed due to the plus coupling is returned to the normal light emitting operation point, and no luminance variation due to the coupling is caused. In this manner, the display apparatus according to the embodiment of the present invention can perform the series of correction operations while the power supply voltage Vdd of the panel is fixed to a constant value. Without increasing the manufacturing cost for the panel, it is possible to prevent the uniformity degradation such as crosstalk or shading.

Figure 7:
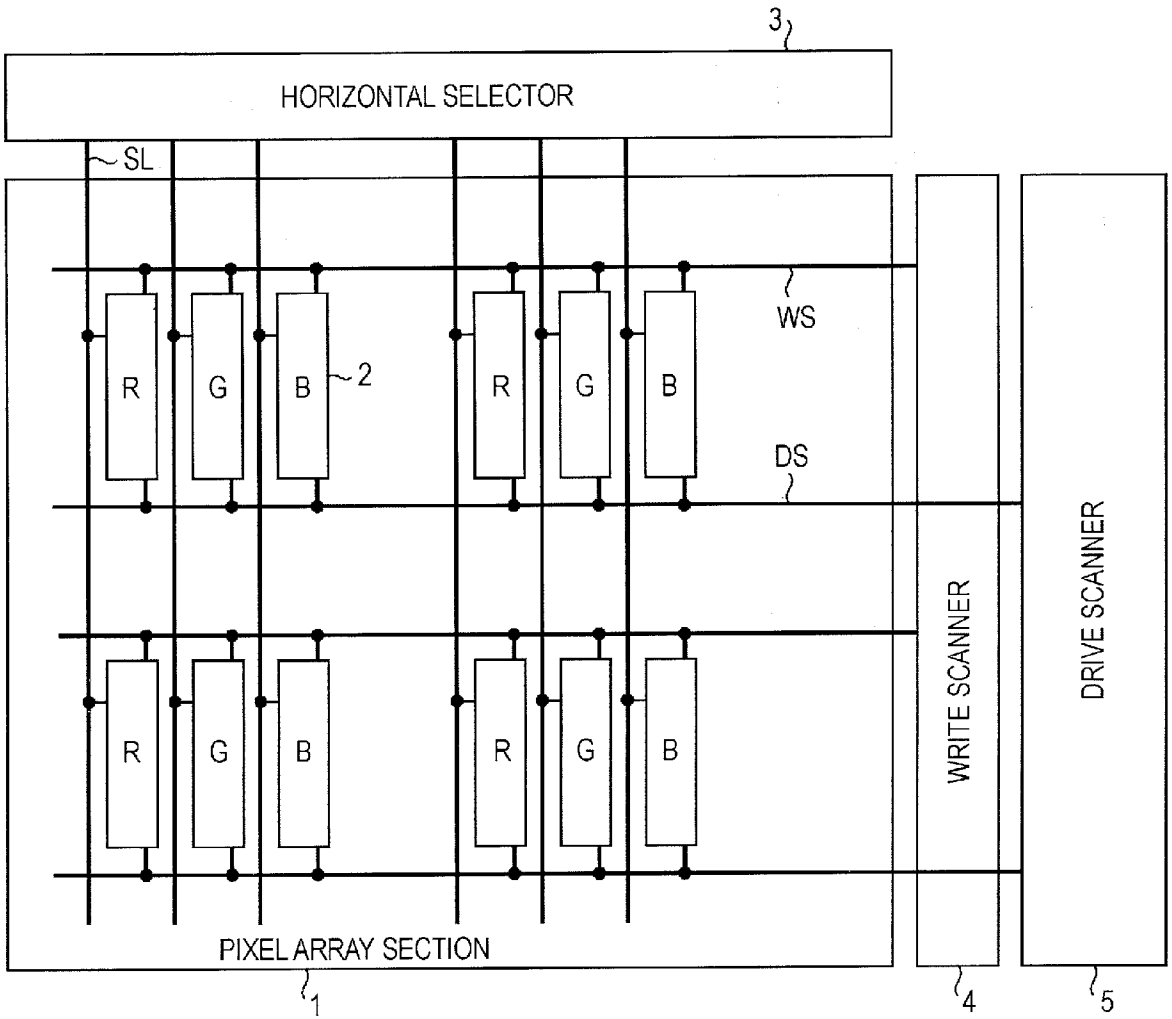
FIG. 7 is a block diagram of an entire configuration of another display apparatus example according to a related development.

FIG. 7 is a block diagram of another example of the display apparatus according to the related development. As illustrated in the drawing, this active matrix display apparatus is composed of the pixel array section 1 functioning as a main section, and a peripheral drive section. The peripheral drive section includes the horizontal selector 3, the write scanner 4, the drive scanner 5, and the like. The pixel array section 1 is composed of the scanning lines WS arranged in rows, the signal lines SL arranged in columns, and pixels R, G, and B arranged in matrix at positions where the scanning lines intersect with the signal lines. In order to enable color display, pixels of three primary colors R, G, and B are prepared, but the configuration is not limited to the above. Each of the pixels R, G, and B is composed of the pixel circuit 2. The signal line SL is driven by the horizontal selector 3. The horizontal selector 3 constitutes a signal section. In general, a driver IC is used for the horizontal selector 3. The driver IC supplies the signal line SL with a video signal. The scanning line WS is scanned by the write scanner 4. It should be noted that a second scanning line DS is also arranged in parallel with the first scanning line WS. The scanning line DS is scanned by a drive scanner 5. The write scanner 4 and the drive scanner 5 constitute a scanner section. The scanner section sequentially scans the rows in the pixels for the one horizontal scanning period. When one of the pixel circuits 2 is selected by the scanning line WS, the selected pixel circuit 2 samples the video signal from the signal line SL. Furthermore, when one of the pixel circuits 2 is selected by the scanning line DS, the selected pixel circuit 2 drives the light emitting element included in the pixel circuit 2 in accordance with the sampled video signal. In addition, when the pixel circuit 2 is controlled by the scanning lines WS and DS in the horizontal scanning period, the predetermined correction operation is performed.

The above-mentioned the pixel array section 1 is formed on an insulating substrate made of glass or the like in general cases and structured as a flat panel. The respective pixel circuits 2 are formed of an amorphous silicon thin film transistor (TFT) or a low temperature polysilicon TFT. In the case of the amorphous silicon TFT, the scanner section is constructed of a TAB different from the panel, and is connected to the flat panel via a flexible cable. Similarly, the signal section is also constructed of an externally attached driver IC, and is connected to the flat panel via a flexible cable. In the case of the low temperature polysilicon TFT, the signal section and the scanner section can be formed of the same low temperature polysilicon TFT. Thus, it is possible to integrally form the pixel array section, the signal section, and the scanner section on the flat panel.

Figure 8:
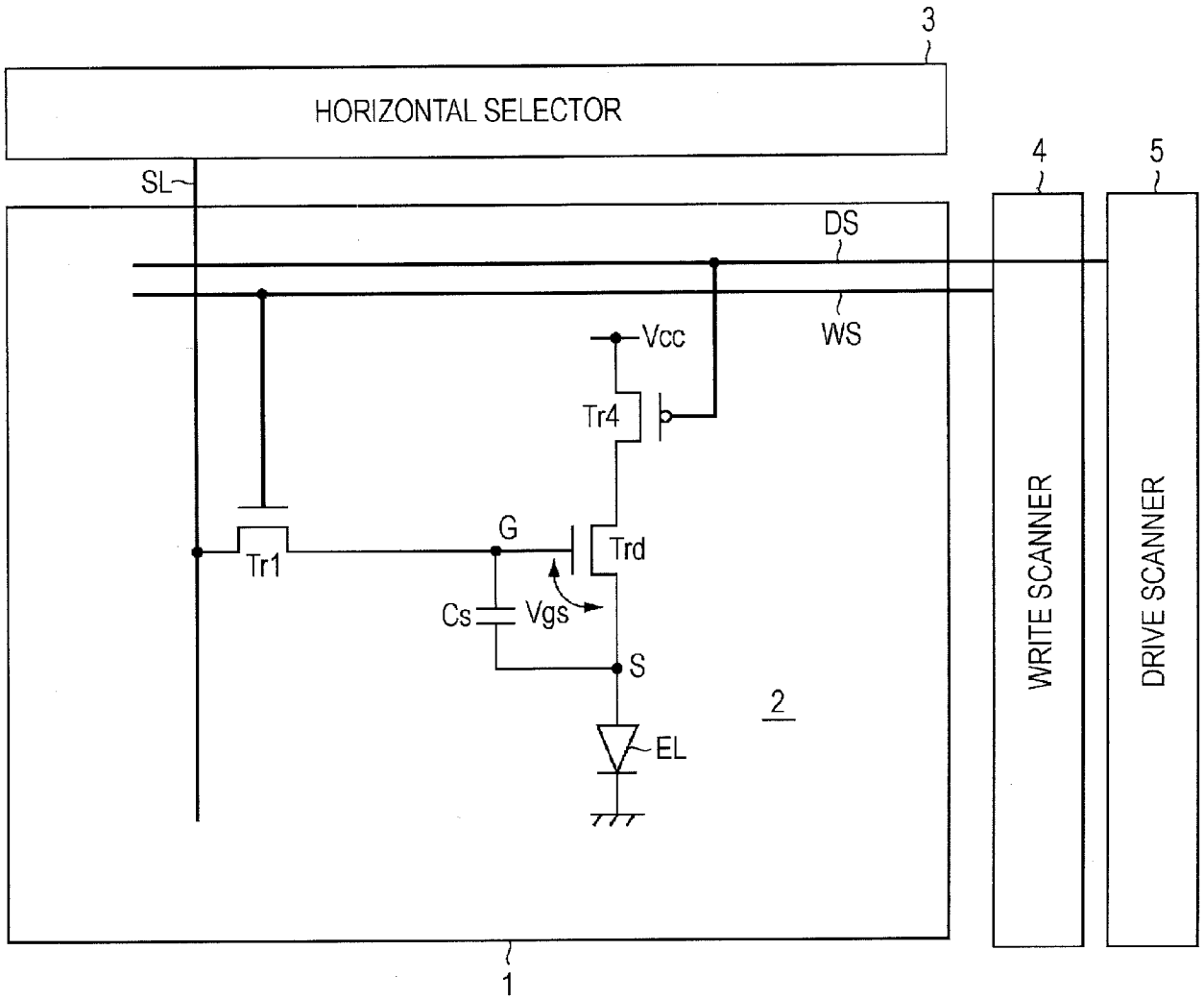
FIG. 8 is a circuit diagram of a specific configuration of the display apparatus illustrated in FIG. 7.

FIG. 8 is a circuit diagram of a configuration of the pixel circuit 2 which is embedded in the display apparatus illustrated in FIG. 7. In the display apparatus according to the related development illustrated in FIG. 2, the pixel is basically composed of two transistors of the sampling transistor and the drive transistor. In contrast to this, the display apparatus according to the related development illustrated in FIG. 8 includes, in addition to the sampling transistor and the drive transistor, a switching transistor Tr4 adapted to perform a duty control on the light emission period and the light non-emission period in the respective fields. That is, the pixel circuit 2 includes the sampling transistor Tr1, the holding capacitance Cs connected to the sampling transistor Tr1, the drive transistor Trd connected to the holding capacitance Cs, the light emitting element EL connected to the drive transistor Trd, and the switching transistor Tr4 for connecting the drive transistor Trd to the power supply Vcc.

The sampling transistor Tr1 establishes a continuity in accordance with a control signal WS which is supplied from the first scanning line WS and samples the signal potential Vsig of the video signal which is supplied from the signal line SL in the holding capacitance Cs. The holding capacitance Cs applies the gate G of the drive transistor Trd with the input voltage Vgs in accordance with the sampled signal potential Vsig of the video signal. The drive transistor Trd supplies the light emitting element EL with the output current Ids in accordance with the input voltage Vgs. It should be noted that the output current Ids has dependency with respect to the threshold voltage Vth of the drive transistor Trd. The light emitting element EL emits light at the luminance in accordance with the signal potential Vsig of the video signal based on the output current Ids which is supplied from the drive transistor Trd during the light emission period. The switching transistor Tr4 establishes a continuity in accordance with the control signal DS supplied from the second scanning line DS and connects the drive transistor Trd to the power supply Vcc during the light emission period. During the light non-emission period, the switching transistor Tr4 is in a non-continuity state and cuts off the drive transistor Trd from the power supply Vcc.

The scanner section composed of the write scanner 4 and the drive scanner 5 is adapted to output the control signals WS and DS respectively to the first scanning line WS and the second scanning line DS during the horizontal scanning period (1H), and control ON and OFF of the sampling transistor Tr1 and the switching transistor Tr4. In addition, in order to the dependency of the output current Ids with respect to the threshold voltage Vth, the scanner section is adapted to execute a preparation operation for resetting the holding capacitance Cs, a correction operation for writing a voltage for canceling the threshold voltage Vth in the reset holding capacitance Cs, and a sampling operation for sampling a signal potential at a video signal Vsig in the corrected holding capacitance Cs. On the other hand, the signal section composed of the horizontal selector (the driver IC) 3 is adapted to switch the video signal during the horizontal scanning period (1H) among a first fixed potential VssH, a second fixed potential VssL, and the signal potential Vsig to supply the respective pixels with potentials necessary for the preparation operation, the correction operation, and the sampling operation described above via the signal line SL.

To be more specific, the horizontal selector 3 first supplies the first fixed potential VssH at the high level and then switches into the second fixed potential VssL at the low level to enable the preparation operation. While the second fixed potential VssL at the still lower level is maintained, the horizontal selector 3 executes the correction operation, and thereafter switches into the signal potential Vsig to execute the sampling operation. As described above, the horizontal selector 3 is composed of the driver IC, and includes a signal generation circuit adapted to generate the signal potential Vsig and an output circuit adapted to insert the first fixed potential VssH and the second fixed potential VssL to the signal potential Vsig which is output from the signal generation circuit to synthesize a video signal in which the first fixed potential VssH, the second fixed potential VssL, and the signal potential Vsig are switched and output the video signal to the respective signal lines SL.

In the drive transistor Trd, the output current Ids also has dependency with respect to a carrier mobility μ in a channel area, as well as the threshold voltage Vth. In this case, the scanner section composed of the write scanner 4 and the drive scanner 5 outputs a control signal to the second scanning line DS during the horizontal scanning period (1H) to further control the switching transistor Tr4. In order to eliminate the dependency of the output current Ids with respect to the carrier mobility μ, while the signal potential Vsig is sampled, the scanner section performs an operation for correcting the input voltage Vgs by taking out an output current from the drive transistor Trd and performing a negative feedback of the output current to the holding capacitance Cs.

Figure 9:
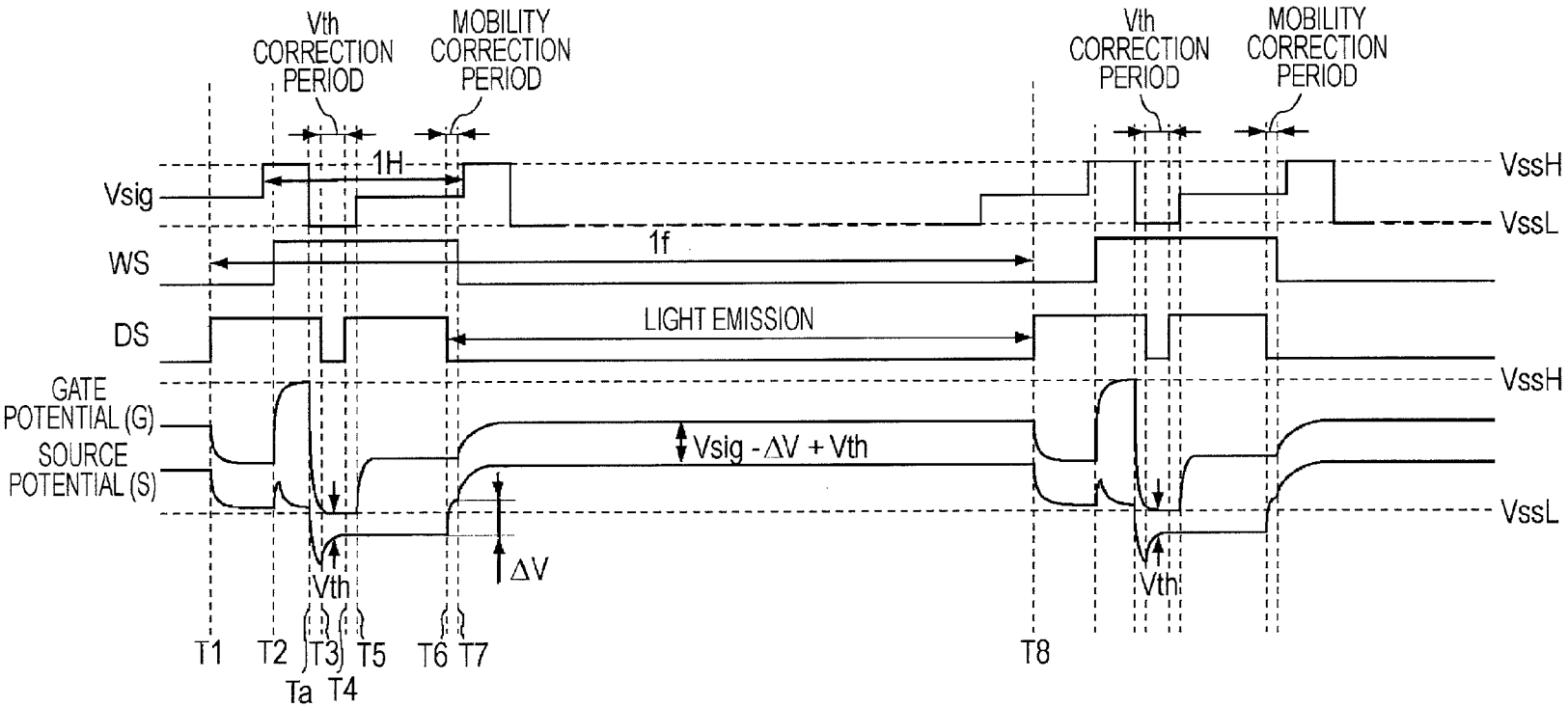
FIG. 9 is a timing chart used for describing an operation of the display apparatus illustrated in FIG. 8.

FIG. 9 is a timing chart of the pixel circuit illustrated in FIG. 8. With reference to FIG. 9, an operation of the pixel circuit illustrated in FIG. 8 will be described. FIG. 9 illustrates waveforms of control signals applied to the respective scanning lines WS and DS along with a time axis T. To simplify the representation, the control signals are also denoted by the same reference numerals as those for the corresponding scanning lines. In addition, a waveform of the video signal applied to the signal lines is illustrated along the time axis T. As illustrated in the drawing, this video signal is switched in every horizontal scanning period (1H) among the high potential VssH, the low potential VssL, and the signal potential Vsig in turn. The transistor Tr1 is of the N channel type. When the scanning line WS is at the high level, the transistor Tr1 is turned ON, and when the scanning line WS is at the low level, the transistor Tr1 is turned OFF. On the other hand, the transistor Tr4 is of the P channel type. When the scanning line DS is at the high level, the transistor Tr4 is turned OFF, and when the scanning line WS is at the low level, the transistor Tr4 is turned ON. It should be noted that this timing chart also illustrates, along with the waveforms of the respective control signals WS and DS and the waveform of the video signal, a potential change at the gate G of the drive transistor Trd and a potential change at the source S.

In the timing chart of FIG. 9, timings T1 to T8 are defined as one field (1f). In the one field, the respective rows in the pixel array are sequentially scanned once. The timing chart illustrates the waveforms of the respective control signals WS and DS applied to the pixels in one row.

First, at the timing T1, the switching transistor Tr4 is turned OFF to establish the light non-emission state. At this time, as there is no power supply from Vcc, the source potential of the drive transistor Trd is lowered to a cut-off voltage VssEL of the light emitting element EL.

Next, at the timing T2, the sampling transistor Tr1 is turned ON. However, before this turning ON, the signal line voltage is preferably increased to VssH because the write period of time can be shortened. When the sampling transistor Tr1 is turned ON, VssH is written in the gate potential of the drive transistor Trd. At this time, the coupling is input to the source potential via the holding capacitance Cs, and the source potential is increased. The potential at the source S is once increased, but is then discharged via the light emitting element EL. Thus, the source voltage is back to VssEL again. At this time, the gate voltage remains at VssH.

Next, at the timing Ta, while the sampling transistor Tr1 is kept turned ON, the signal voltage is changed into VssL. This potential change is coupled to the source potential via the holding capacitance Cs. At this time, the coupling amount is obtained through an expression: Cs/(Cs+Coled)×(VssH−VssL). At this time, the gate potential is represented by VssL, and the source potential is represented by VssEL−Cs (Cs+Coled)×(VssH−VssL). At this time, the minus bias is input, and that is why the source voltage becomes smaller than VssEL and the light emitting element EL is cut off. At this time, the source potential is preferably set as a potential at which the light emitting element EL is kept being cut off even after the completion of the Vth correction and the mobility correction to be executed in later stages. In addition, through the input of the coupling so that Vgs>Vth is established, the Vth correction preparation can be carried out. With the above-mentioned operations, even in the circuit in which the numbers of the transistors, the power supply lines, and the gate lines are reduced, the Vth correction preparation can be carried out. That is, a period from the timing T2 to the time Ta is included in the correction preparation period.

After that, at the timing T3, when the switching transistor Tr4 is turned ON while the gate G is held at VssL, the current flows into the drive transistor Trd, and the Vth correction is carried out. The current flows until the drive transistor Trd is cut off. When the cut-off is caused, the source potential of the drive transistor Trd becomes VssL−Vth. At this time, it is necessary to establish the following relation: VssL−Vth<VssEL.

After that, at the timing T4, the switching transistor Tr4 is turned OFF, and the Vth correction is finished. That is, a period from the timing T3 to the timing T4 is the Vth correction period.

In this manner, after the Vth correction is carried out in the period from the timing T3 to the timing T4, at the timing T5, the potential of the signal line is changed from VssL to Vsig. As a result, the signal potential Vsig of the video signal is written in the holding capacitance Cs. As compared with the equivalent capacitance Coled of the light emitting element EL, the holding capacitance Cs is sufficiently small. In this sequence, almost all the part of the signal potential Vsig is written in the holding capacitance Cs. Therefore, the voltage Vgs between the gate G and the source S of the drive transistor Trd is at a level (Vsig+Vth) in which Vth previously detected and held is added with Vsig sampled this time. That is, the input voltage Vgs with respect to the drive transistor Trd becomes Vsig+Vth. Such sampling for the signal voltage Vsig is performed until the timing T7 at which the control signal WS is returned to the low level. That is, a period from the timing T5 to the timing T7 is equivalent to a sampling period.

The present pixel circuit also performs the correction on the mobility μ in addition to the above-mentioned correction on the threshold voltage Vth. The correction on the mobility μ is performed from the timing T6 to the timing T7. As illustrated in the timing chart, the correction amount ΔV is subtracted from the input voltage Vgs.

At the timing T7, the control signal WS is set at the low level, and the sampling transistor Tr1 is turned OFF. In this sequence, the gate G of the drive transistor Trd is cut off from the signal line SL. As the application of the video signal Vsig is cancelled, the gate potential of the drive transistor Trd (G) can be increased and is increased together with the source potential (S). During that period, the voltage Vgs between the gate and the source which is held in the holding capacitance Cs keeps the value of (Vsig−ΔV+Vth). Along with the increase in the source potential (S), the reverse bias state of the light emitting element EL is cancelled. Through the inflow of the output current Ids, the light emitting element EL actually starts emitting light.

Finally, at the timing T8, the control signal DS is set at the high level and the switching transistor Tr4 is turned OFF. The light emission is finished and also the current field is ended. After that, the next field begins, and the correction preparation operation, the Vth correction operation, the mobility correction operation, and the light emission operation are repeatedly carried out.

However, in order to carry out the preparation operation for the threshold voltage correction operation, the display apparatus according to the related development illustrated in FIGS. 7 to 9 needs to write a high voltage like VssH in the gate G of the drive transistor Trd from the signal line SL. Thus, the signal voltage driver constituting the horizontal selector 3 needs to be manufactured as a high-voltage signal voltage driver, which leads to the increase in costs. Furthermore, in order to write the high voltage VssH, the voltage of the control signal WS applied to the gate of the sampling transistor Tr1 which samples the high voltage VssH needs to be set high, which leads to the increase in the power consumption of the panel. In addition, after the high voltage VssH is written in the gate G of the drive transistor Trd, it takes time until the source potential is attenuated. Therefore, the high speed drive of the panel and also the higher definition of the panel are difficult to achieve.

Figure 10:
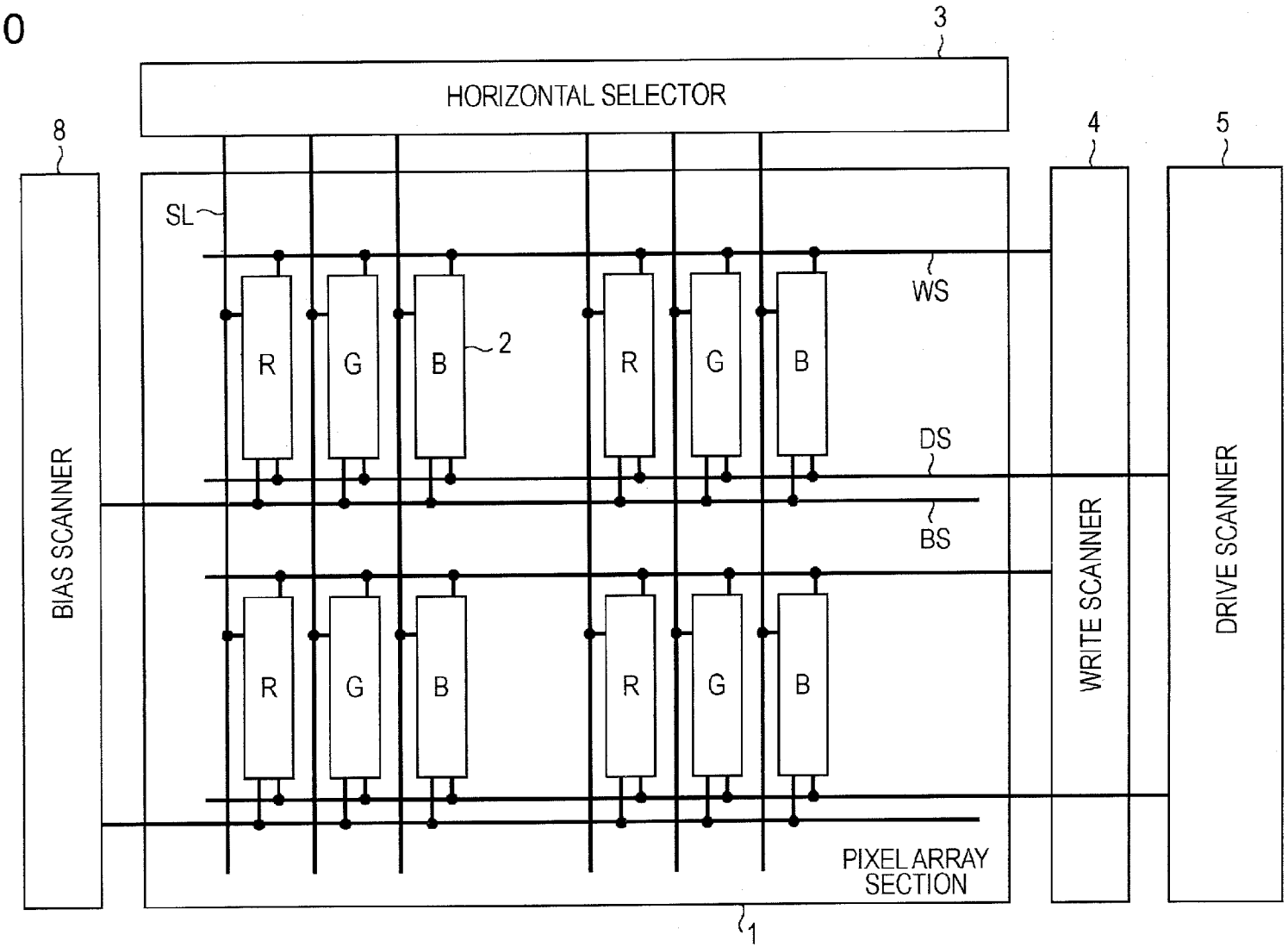
FIG. 10 is a block diagram of another display apparatus example according to an embodiment of the present invention.

FIG. 10 is a block diagram of the display apparatus according to the embodiment of the present invention. The present display apparatus has been made to deal with the problems in the display apparatus according to the related development illustrated in FIG. 7. To facilitate the understanding, parts corresponding to those for the display apparatus illustrated in FIG. 7 are allocated with the corresponding reference numerals. A difference resides in that the present display apparatus illustrated in FIG. 10 is provided with the bias scanner 8 and the bias lines BS. The bias lines BS are arranged in parallel to the scanning line WS in the pixel array section 1. The bias scanner 8 is adapted to perform the line sequential scanning on the bias lines BS arranged in rows and switch the potential on the bias line BS between high and low.

Figure 11:
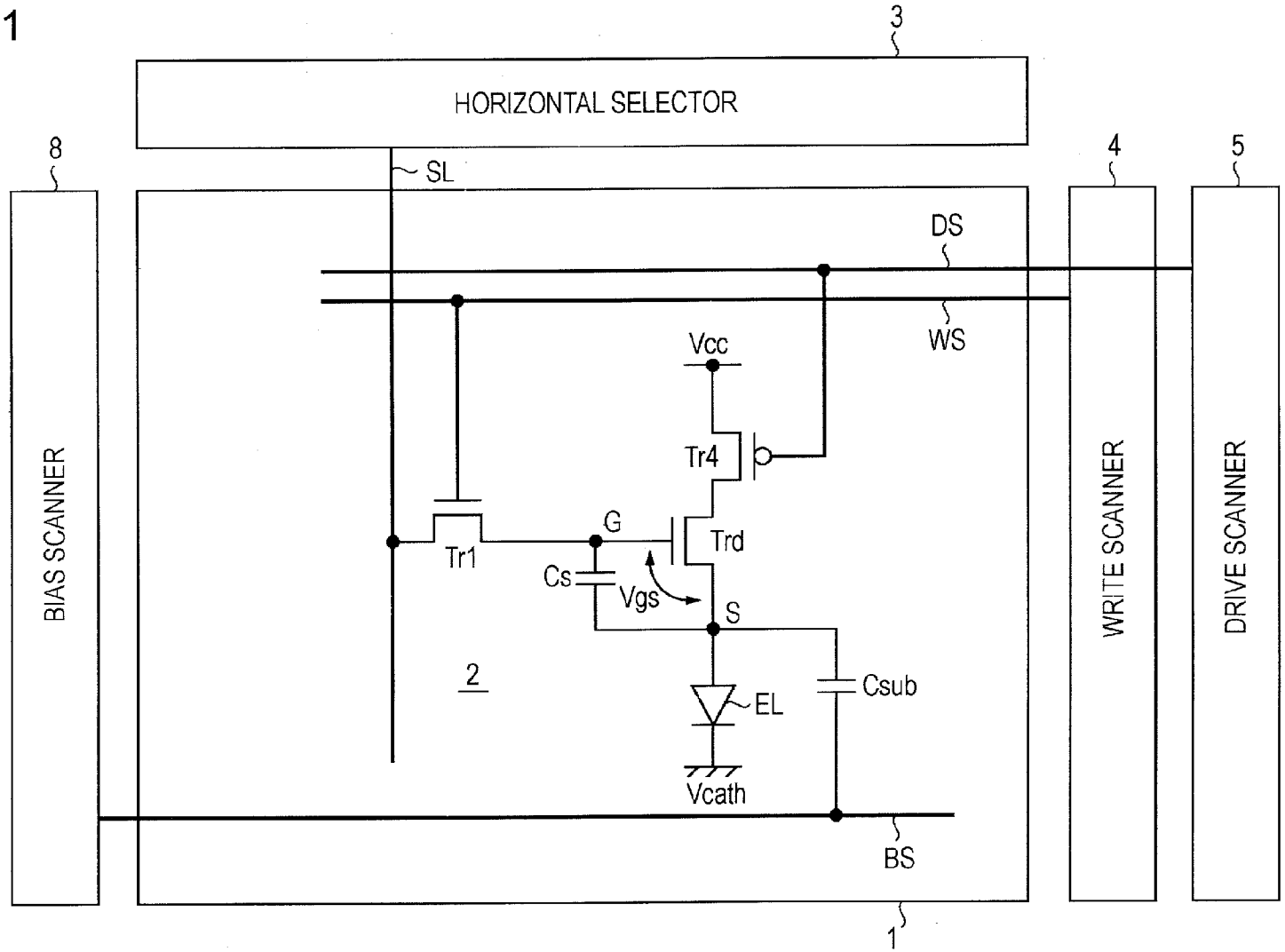
FIG. 11 is a circuit diagram of a specific configuration of the display apparatus illustrated in FIG. 10.

FIG. 11 is a circuit diagram of a specific configuration of the display apparatus according to the embodiment of the present invention illustrated in FIG. 10. Basically, the display apparatus according to the embodiment of the present invention is similar to the display apparatus according to the related development illustrated in FIG. 8, and corresponding parts are allocated with the corresponding reference numerals. A difference resides in that the auxiliary capacitance Csub is arranged in the pixel circuit 2 in addition to the holding capacitance Cs. One terminal of the auxiliary capacitance Csub is connected to the source S of the drive transistor Trd and the other terminal is connected to the bias line BS. The present display apparatus uses the auxiliary capacitance Csub to input a minus coupling voltage ΔVs to the source S of the drive transistor Trd, thus carrying out the preparation operation for the threshold voltage correction operation.

Figure 12:
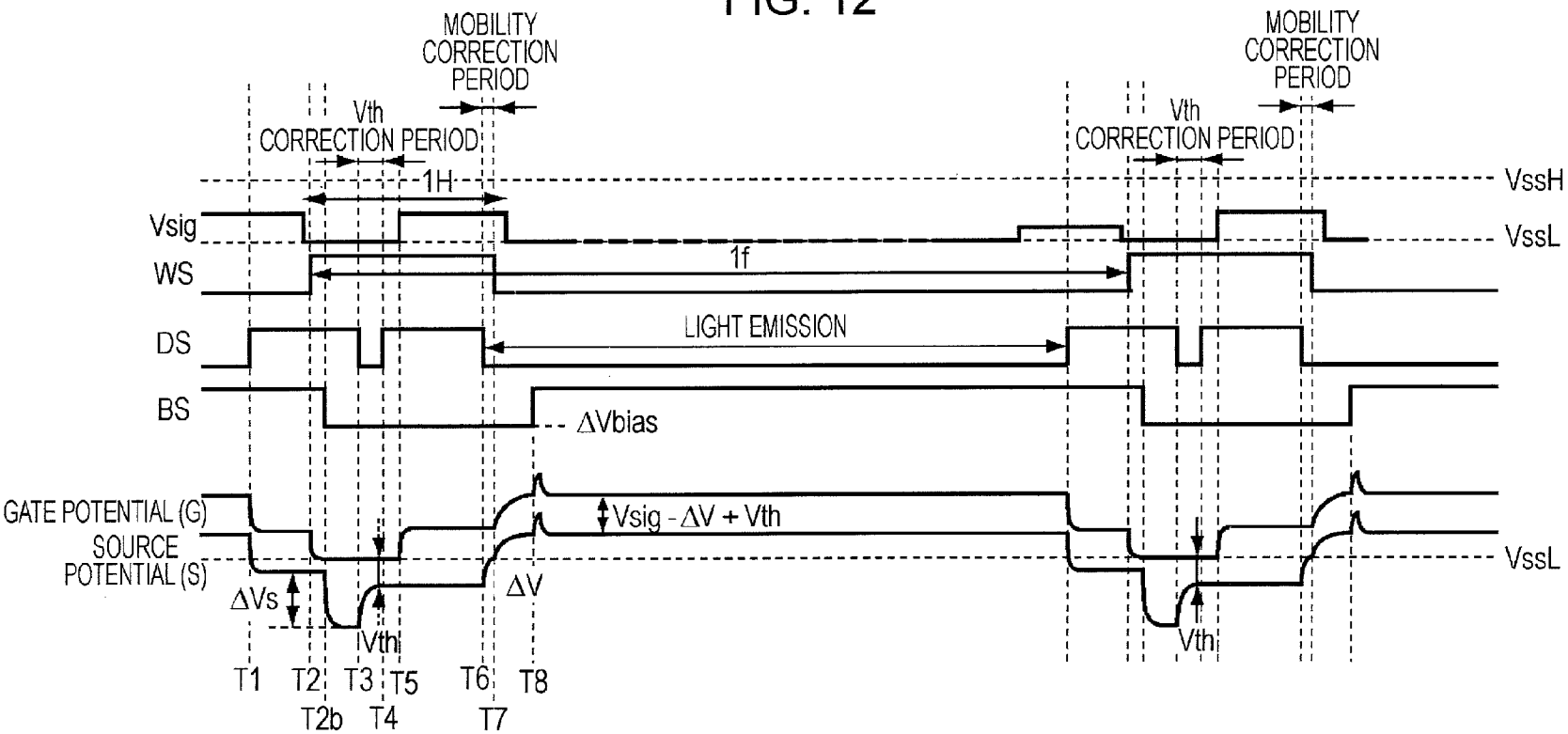
FIG. 12 is a timing chart used for describing an operation of the display apparatus illustrated in FIG. 11.

FIG. 12 is a timing chart used for describing an operation of the display apparatus according to the embodiment of the present invention illustrated in FIG. 11. To facilitate the understanding, a similar representation is adopted as the timing chart for the display apparatus according to the related development illustrated in FIG. 9. The timing chart of FIG. 12 illustrates, in addition to the potential changes at the signal line SL, the scanning line WS, and the scanning line DS, a potential change of the bias line BS as well. At the bias line BS, the potential is changed by ΔVbias between the high level and the low level. It should be noted that the display apparatus according to the embodiment of the present invention is different from the display apparatus according to the related development in that the signal line SL is switched between the low potential VssL and the signal potential Vsig. This switching is performed in units of the one horizontal cycle (1H). Therefore, the signal line SL is different from the related development example in that the signal line SL is not switched to the high potential VssH, and therefore it is not necessary to use the high-voltage signal driver for the horizontal selector.

First, at a timing T1, the scanning line DS is switched to the high level, and the switching transistor Tr4 is turned OFF. As a result, the drive transistor Trd is cut off from the power supply line Vcc, and thus the light non-emission period begins.

Subsequently, at a timing T2, the scanning line WS is applied with the control signal, and the sampling transistor Tr1 is turned ON. At this time, the signal line SL is at the low level VssL. Therefore, at the timing T2, via the sampling transistor Tr1 which has been turned ON, the low potential VssL is written in the gate G of the drive transistor Trd from the signal line SL.

Then, at a timing T2*b*, the bias line BS is switched from the high potential to the low potential. As a result, via the auxiliary capacitance Csub, the minus coupling voltage ΔVs is input to the source S of the drive transistor Trd, and the source potential is substantially decreased. At this time, when the potential change amount at the bias line BS is set as ΔVbias, the capacity coupling amount ΔVs is represented through the following expression.

$$\Delta Vs = \Delta V\text{bias} \times C\text{sub}/(Cs + C\text{sub})$$

In this manner, in a state where the gate G of the drive transistor Trd is grounded to VssL, the minus coupling voltage ΔVs can be input to the source S. Such a potential at the bias line BS is set that Vgs>Vth is established through the coupling, and thus the threshold voltage correction operation following this can be performed.

After that, at a timing T3, when the switching transistor Tr4 is turned ON while the gate G is held at VssL, the current flows into the drive transistor Trd, the Vth correction is carried out similarly to the related development example. The current flows until the drive transistor Trd is cut off. When the cut-off is caused, the source potential of the drive transistor Trd becomes VssL−Vth. At this time, it is necessary to establish the following relation: VssL−Vth<VssEL.

After that, at a timing T4, the switching transistor Tr4 is turned OFF, and the Vth correction is finished. That is, a period from the timing T3 to the timing T4 is the Vth correction period.

In this manner, after the Vth correction is carried out in the period from the timing T3 to the timing T4, at a timing T5, the potential of the signal line is changed from VssL to Vsig. As a result, the signal potential Vsig of the video signal is written in the holding capacitance Cs. As compared with the equivalent capacitance Coled of the light emitting element EL, the holding capacitance Cs is sufficiently small. In this sequence, almost all the part of the signal potential Vsig is written in the holding capacitance Cs. Therefore, the voltage Vgs between the gate G and the source S of the drive transistor Trd is at a level (Vsig+Vth) in which Vth previously detected and held is added with Vsig sampled this time. That is, the input voltage Vgs with respect to the drive transistor Trd becomes Vsig+Vth. Such sampling for the signal voltage Vsig is performed until a timing T7 at which the control signal WS is returned to the low level. That is, a period from the timing T5 to the timing T7 is equivalent to a sampling period.

The present pixel circuit also carries out the correction on the mobility μ in addition to the above-mentioned correction on the threshold voltage Vth. The correction on the mobility μ is performed from the timing T6 to the timing T7. As illustrated in the timing chart, the correction amount ΔV is subtracted from the input voltage Vgs.

At the timing T7, the control signal WS is set at the low level, and the sampling transistor Tr1 is turned OFF. In this sequence, the gate G of the drive transistor Trd is cut off from the signal line SL. As the application of the video signal Vsig is cancelled, the gate potential of the drive transistor Trd (G) can be increased and is increased together with the source potential (S). During that period, the voltage Vgs between the gate and the source which is held in the holding capacitance Cs keeps the value of (Vsig−ΔV+Vth). Along with the increase in the source potential (S), the reverse bias state of the light emitting element EL is cancelled. Through the inflow of the output current Ids, the light emitting element EL actually starts emitting light.

After the light emission period begins in the current field at the timing T7, the bias line BS is returned from the low level to the high level at a timing T8 to prepare for the next field. At that time, when the bias line BS is returned to the high level, a plus coupling is input to the source S of the drive transistor Trd, but the gate G at this time is in the high impedance state. The holding capacitance Cs keeps holding the signal potential as it is. Thus, the source potential temporarily varying due to the plus coupling is immediately returned to the normal light emission operation point, and no luminance change due to the coupling is caused.

As described above, the display apparatus according to the embodiment of the present invention initializes the source potential of the drive transistor Trd through the minus coupling via the bias line BS, and therefore it is not necessary to input the high potential VssH from the signal line SL side unlike the related development example. In the display apparatus according to the embodiment of the present invention, it is possible to suppress a voltage swing of the signal supplied to the signal line SL to a low level, and the lower cost for the signal driver and the lower power consumption of the panel can be achieved at the same time.

Figure 13:
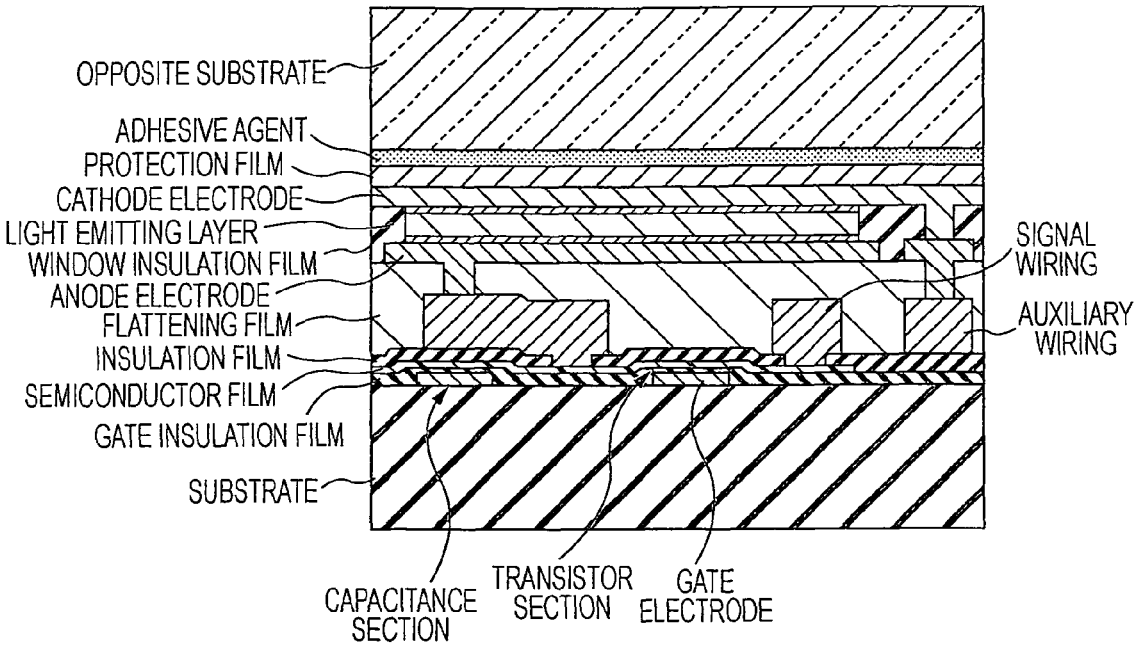
FIG. 13 is a cross sectional view of a device structure of the display apparatus according to the embodiment of the present invention.

The display apparatus according to the embodiment of the present invention has a thin film device structure illustrated in FIG. 13. This drawing illustrates a schematic cross sectional structure of the pixel formed on an insulating substrate. As described in the drawing, the pixel includes a transistor section having a plurality of thin film transistors (one TFT is exemplified in this drawing), a capacitance section having a holding capacitance, and a light emission section having an organic EL element, etc. The transistor section and the capacitance section are formed on the substrate through a TFT process, and the light emission section having the organic EL element, and the like are laminated on top. A transparent opposite substrate is affixed on top through an adhesive agent to produce a flat panel.

Figure 14:
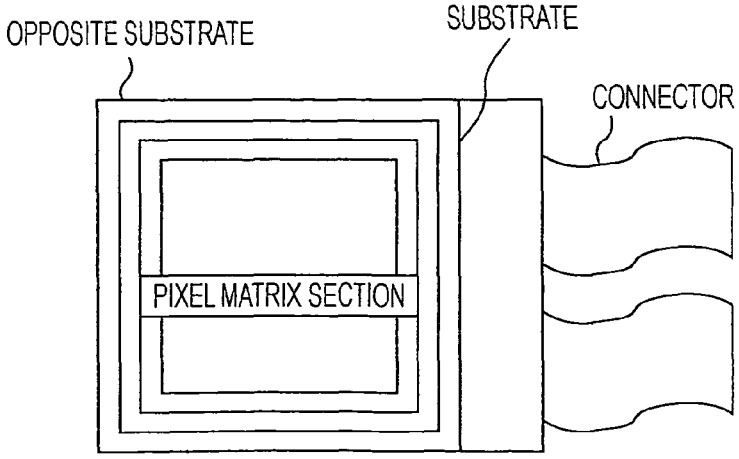
FIG. 14 is a plan view of a module configuration of the display apparatus according to the embodiment of the present invention.

As illustrated in FIG. 14, the display apparatus according to the embodiment of the present invention includes a flat type module display apparatus. For example, a pixel array section in which pixels each including an organic EL element, thin film transistors, a thin film capacitance, and the like are integrally formed in matrix is provided on an insulating substrate, an adhesive agent is arranged so as to surround this pixel array section (pixel matrix section), and an opposite substrate made of glass or the like is affixed on top to produce a display module. A color filter, a protection film, a light blocking film, or the like may be provided to this transparent opposite substrate. An FPC (flexible print circuit) may be provided, for example, for a connector for inputting and outputting a signal or the like from the outside to the pixel array section may be provided to the display module.

The display apparatus according to the embodiment of the present invention described above has a flat panel shape, and can be applied to various electronic equipment, for example, a digital camera, a laptop personal computer, a mobile phone, or a video camera, or applied to a display of an electronic equipment in any field which displays a video signal input to the electronic equipment or generated in the electronic equipment as an image or a video. Hereinafter, examples of the electronic equipment to which such a display apparatus is applied will be illustrated.

Figure 15:
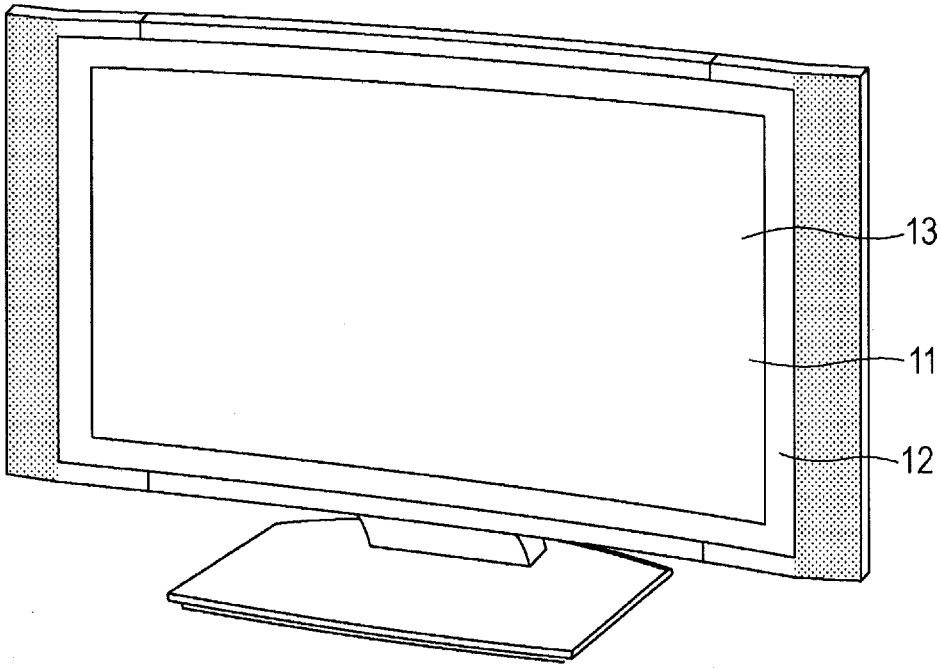
FIG. 15 is a perspective view of a television set provided with the display apparatus according to the embodiment of the present invention.

FIG. 15 illustrates a television set to which the embodiment of the present invention is applied. The television set includes a video display screen 11 composed of a front panel 12, a filter glass 13, and the like. The display apparatus according to the embodiment of the present invention is used for the video display screen 11 to manufacture the television set.

Figure 16:
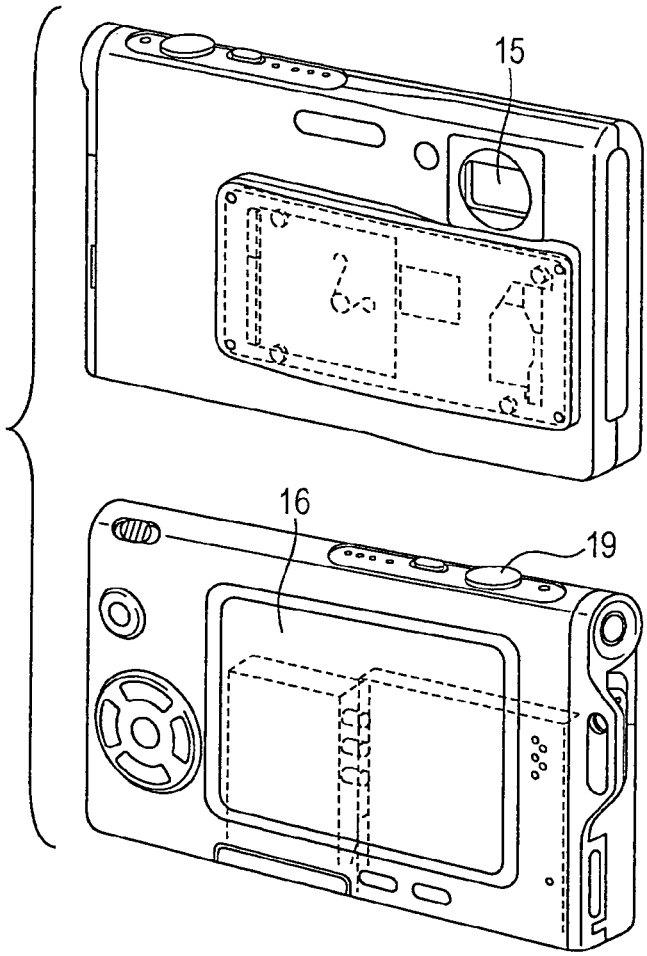
FIG. 16 is a perspective view of a digital still camera provided with the display apparatus according to the embodiment of the present invention.

FIG. 16 illustrates a digital camera to which the embodiment of the present invention is applied, in which an upper part is a front view and a lower part is a rear view. This digital camera includes an image pickup lens, a light emission section 15 for flash, a display section 16, a control switch, a menu switch, a shutter 19, and the like, the display apparatus according to the embodiment of the present invention is used for the display section 16 to manufacture the digital camera.

Figure 17:
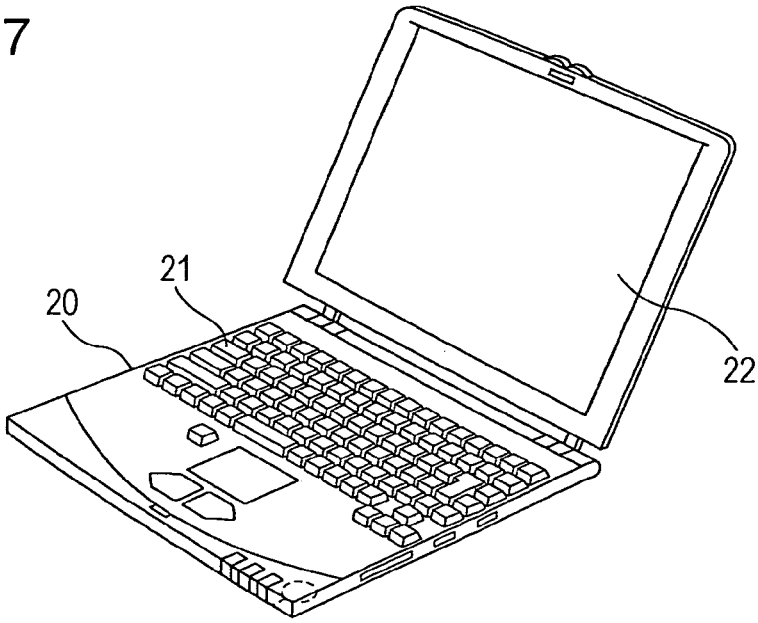
FIG. 17 is a perspective view of a laptop personal computer provided with the display apparatus according to the embodiment of the present invention.

FIG. 17 illustrates a laptop personal computer to which the embodiment of the present invention is applied. A main body 20 includes a key board which is operated when a character or the like is input. A main body cover includes a display section 22 adapted to display an image. The display apparatus according to the embodiment of the present invention is used for the display section 22 to manufacture the laptop personal computer.

Figure 18:
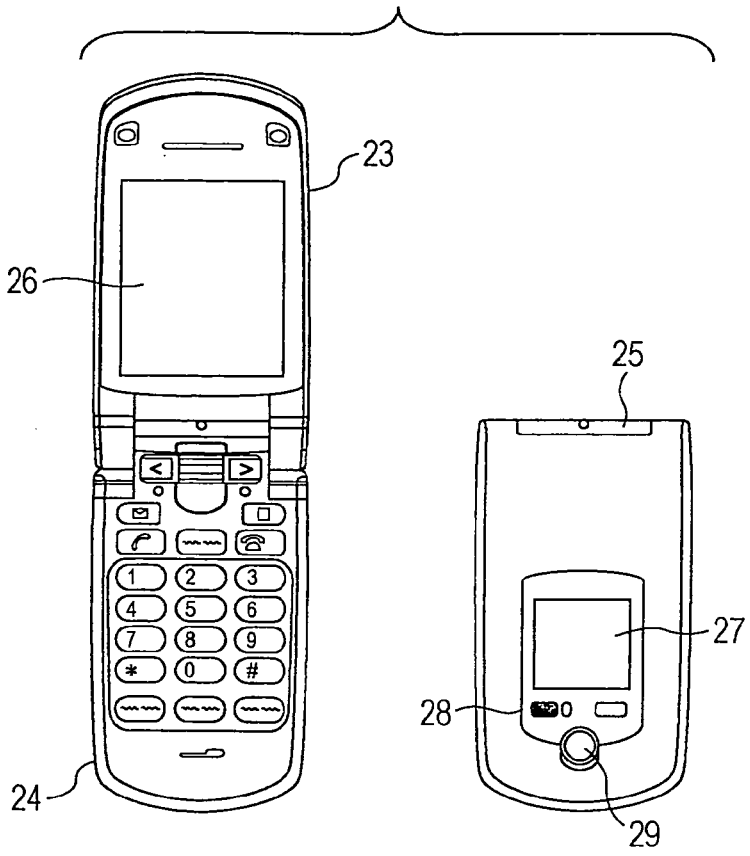
FIG. 18 is a schematic diagram of a mobile telephone apparatus provided with the display apparatus according to the embodiment of the present invention.

FIG. 18 illustrates a mobile terminal apparatus to which the embodiment of the present invention is applied, in which a left part represents an opened state and a right part represents a closed state. This mobile terminal apparatus includes an upper casing 23, a lower casing 24, a coupling section (hinge section in this case) 25, a display 26, a sub display 27, a picture light 28, a camera 29, and the like. The display apparatus according to the embodiment of the present invention is used for the display 26 and the sub display 27 to manufacture the mobile terminal apparatus.

Figure 19:
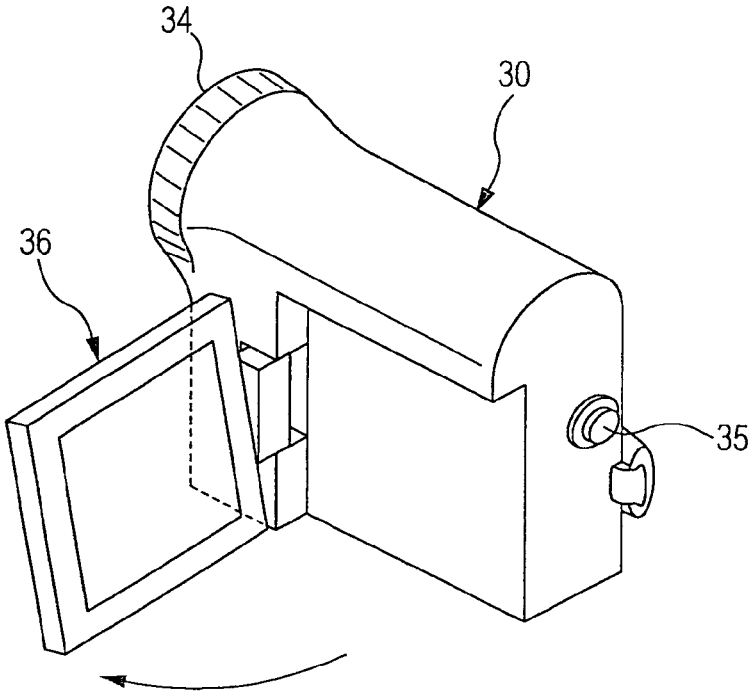
FIG. 19 is a perspective view of a video camera provided with the display apparatus according to the embodiment of the present invention.

FIG. 19 illustrates a video camera to which the embodiment of the present invention is applied. This video camera includes a main body section 30, a lens 34 for a subject image pickup which is provided on a side and faces forwards, a start/stop switch 35 for the image pickup, a monitor 36, and the like. The display apparatus according to the embodiment of the present invention is used for the monitor 36 to manufacture the video camera.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array section; and a drive section, the pixel array section including pixels arranged in matrix and bias lines, each of the pixels including a drive transistor, a light emitting element, a holding capacitance, and an auxiliary capacitance, the auxiliary capacitance being connected between a first terminal of the holding capacitance and the bias line, wherein the drive section is configured to carry out a correction operation for holding a voltage equivalent to a threshold voltage of the drive transistor in the holding capacitance, and the drive section switches potentials at the bias line and adds a coupling voltage to the first terminal of the holding capacitance via the auxiliary capacitance to set a potential difference between a control terminal and a first current terminal of the drive transistor larger than the threshold voltage.

2. An electronic equipment comprising the display apparatus according to claim 1.

3. The display device according to claim 1, further comprising a first transistor and a first wiring wherein the first transistor is configured to supply a reference voltage from the first wiring to a control terminal of the drive transistor.

4. The display device according to claim 3, wherein a control terminal of the first transistor is connected to a first control line disposed in parallel to the bias line.

5. The display device according to claim 4, wherein the first wiring is disposed in a first direction perpendicular to the first control line.

6. The display device according to claim 5, wherein the first wiring is configured to supply the reference voltage and a data voltage sequentially.

7. The display device according to claim 4, further comprising a power supply line disposed in parallel to the bias line and the first control line, wherein the drive transistor is configured to supply a drive current from the power supply line to the light emitting element in accordance with a potential held in the holding capacitance.

8. The display device according to claim 3, wherein a control terminal of the first transistor is connected to a first control line, the first control line being made of the same material as the bias line.

9. The display device according to claim 8, wherein the same material comprises molybdenum.

10. The display device according to claim 8, further comprising a power supply line made of the same material as the bias line and the first control line, wherein the drive transistor is configured to supply a drive current from the power supply line to the light emitting element in accordance with a potential held in the holding capacitance.

11. The display device according to claim 3, wherein a potential at the control terminal of the drive transistor is turned into a reference potential during a non-emission period.

12. The display device according to claim 3, wherein the pixel array section is formed on an insulating substrate, the insulating substrate being made of glass.

13. The display device according to claim 12, wherein the pixels comprise an amorphous silicon thin film transistor, and wherein the scanner section is connected to the insulating substrate via a flexible cable.

14. The display device according to claim 12, wherein the pixels comprise a low-temperature polysilicon thin film transistor, and wherein the pixel array section and the scanner section are formed on the insulating substrate.

* * * * *